US007532967B2

(12) United States Patent
Fujishima et al.

(10) Patent No.: US 7,532,967 B2
(45) Date of Patent: May 12, 2009

(54) EXCAVATION TEACHING APPARATUS FOR CONSTRUCTION MACHINE

(75) Inventors: Kazuo Fujishima, Ibaraki-ken (JP); Hideto Ishibashi, Ibaraki-ken (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 790 days.

(21) Appl. No.: 10/498,266

(22) PCT Filed: Sep. 9, 2003

(86) PCT No.: PCT/JP03/11484

§ 371 (c)(1),
(2), (4) Date: Jun. 8, 2004

(87) PCT Pub. No.: WO2004/027164

PCT Pub. Date: Apr. 1, 2004

(65) Prior Publication Data

US 2005/0027420 A1 Feb. 3, 2005

(30) Foreign Application Priority Data

Sep. 17, 2002 (JP) ..... 2002-269468
Sep. 17, 2002 (JP) ..... 2002-269476

(51) Int. Cl.
*G06F 19/00* (2006.01)
*G05D 1/04* (2006.01)
*G06G 7/00* (2006.01)

(52) U.S. Cl. ..... 701/50; 37/348; 37/341

(58) Field of Classification Search ..... 348/118, 348/120, 148; 701/50, 23, 36; 37/304, 305, 37/355, 354, 348, 341, 382; 702/152; 345/419; 172/2, 9, 430

See application file for complete search history.

(56) References Cited

U.S. PATENT DOCUMENTS

| | | | | |
|---|---|---|---|---|
| 5,631,658 | A * | 5/1997 | Gudat et al. | 342/457 |
| 6,076,029 | A * | 6/2000 | Watanabe et al. | 701/50 |
| 6,097,425 | A * | 8/2000 | Behnke et al. | 348/89 |
| 6,114,993 | A * | 9/2000 | Henderson et al. | 342/357.17 |
| 6,282,477 | B1 * | 8/2001 | Gudat et al. | 701/50 |
| 6,655,465 | B2 * | 12/2003 | Carlson et al. | 172/4.5 |
| 6,671,600 | B1 * | 12/2003 | Hintzy | 701/50 |
| 6,751,540 | B2 * | 6/2004 | Keefer et al. | 701/50 |
| 7,079,931 | B2 * | 7/2006 | Sahm et al. | 701/50 |

FOREIGN PATENT DOCUMENTS

| | | | |
|---|---|---|---|
| JP | 2001-98585 | * | 4/2001 |
| JP | 2002-70082 | | 3/2002 |

* cited by examiner

*Primary Examiner*—Thomas G Black
*Assistant Examiner*—Christine M Behncke
(74) *Attorney, Agent, or Firm*—Mattingly & Malur, P.C.

(57) ABSTRACT

The invention is intended to provide an excavation teaching device for a construction machine which can realize easy confirmation of a proper target excavation surface and increase the working efficiency during excavation even in work of forming the face of slope in complicated three-dimensional landforms. A display unit (46) displays, as an image in a first screen area (46*a*), a plurality of small plane surfaces G constituting a three-dimensional target landform and illustrations of a body S of the construction machine and a bucket B as an excavating tool at a fore end of an operating mechanism.

15 Claims, 18 Drawing Sheets

EXCAVATION TEACHING APPARATUS FOR CONSTRUCTION MACHINE

TECHNICAL FIELD

The present invention relates to an excavation teaching device for a construction machine, such as a hydraulic excavator. More particularly, the present invention relates to an excavation teaching device for a construction machine, which is suitable for teaching a target excavating position when excavation is to be performed on a three-dimensional target landform by using an operating mechanism for excavation, such as a bucket.

BACKGROUND ART

When constructing roads in slants in a mountain region, etc., earth moving work, such as cutting and filling-up, is first carried out to form a necessary foundation by using a construction machine, such as a hydraulic excavator and a bulldozer, and the face of slope is then formed around the foundation by using the hydraulic excavator, etc. to prevent breaking of the ground. This slope-face forming is highly accurate excavation and shaping work and requires skills. Particularly, if the earth is excessively excavated up to a position under a target excavation surface, compacting work must be carried out by using a dedicated machine, such as a compactor, to provide the strength substantially equal to that of the base ground because simple backfilling is not sufficient to provide the required strength. This results in a large reduction of working efficiency. For that reason, an operator carefully performs the work of forming the face of slope so that the earth is no excavated beyond the target excavation surface.

On the other hand, as means for teaching the target excavation surface to the operator, numerical values indicating excavation targets, e.g., numerical values regarding the gradient and depth of the slope of surface, are obtained from the result of surveying an original landform at that time, and stakes or plates with those numerical values put on them are set up in many representative positions (called stake setting-up work). While looking at the set-up stakes, the operator operates an operating mechanism of the hydraulic excavator so that the target face of slope is formed. When forming the face of slope in complicated terrains such as slants in a mountain region, a large number of stakes or plates must be set up as guides along the three-dimensional landform, and hence a lot of time is required to carry out surveying and setting-up of the stakes.

In view of the problem mentioned above, JP,A 2001-98585, for example, discloses a device for guiding a target excavation surface through the steps of comparing a three-dimensional position of a construction machine, such as a hydraulic excavator, and the direction of an operating mechanism thereof with a three-dimensional target landform, computing a three-dimensional intersect line between a plane defining a vertical cross-section extending in the same direction as the orientation of the operating mechanism and the three-dimensional target landform, and displaying the computed intersect line together with illustrations of a machine body and the operating mechanism on the same screen of a display unit installed within a cab.

Also, a 3D-MC GPS shovel manufactured by Topcon Corporation, for example, is equipped with a known device wherein triangular polygons representing three-dimensional landforms are displayed on a touch-panel display unit installed in a cab, and an operator teaches one of the displayed triangular polygons, which corresponds to a target excavation surface, by directly touching a display screen, thereby displaying the target excavation surface in a different color.

DISCLOSURE OF THE INVENTION

With the device described in JP,A 2001-98585, because of including the steps of computing a three-dimensional intersect line between a plane defining a vertical cross-section extending in the same direction as the orientation of the operating mechanism and the three-dimensional target landform, and displaying the computed intersect line together with illustrations of a machine body and the operating mechanism on the same screen of a display unit installed within a cab, the operator can certainly recognize the excavation surface from the position where the hydraulic excavator locates at present. However, if the direction in which the operating mechanism operates is not the same as the direction normal to the target face of slope, the bucket is forced to dig into the target surface by an amount corresponding to the bucket width. When forming the face of slope in practice, therefore, additional work has been required for aligning the direction in which the operating mechanism operates with the direction normal to the target face of slope, taking into account the width of the operating mechanism. That necessity has invited a first problem that the work is further complicated.

Also, with the 3D-MC GPS shovel manufactured by Topcon Corporation, an angle formed between the direction in which the operating mechanism operates and the direction normal to the target face of slope is displayed on the same screen as the machine body and the three-dimensional target landform in separate frames, and the operator swings or moves the machine body so that the angle becomes 0. However, this aligning work is required each time the target excavation surface is set. In particular, when a plurality of small plane surfaces are present in a small area, the operator must eventually teach all of those small plane surfaces, thus resulting in a second problem that the work is very troublesome.

Further, with the 3D-MC GPS shovel manufactured by Topcon Corporation, the angle formed between the direction in which the operating mechanism operates and the direction normal to the target face of slope is displayed on the same screen as the machine body and the three-dimensional target landform in separate frames, and the operator swings or moves the machine body so that the angle becomes 0. However, there is no concrete guide indicating in which direction the machine body is to be operated in practice, and hence the direction in which the machine body is to be operated must be judged at the operator's discretion at the time of starting the operation. That necessity has invited a third problem that an unskilled operator cannot easily position the machine body in proper orientation.

A first object of the present invention is to provide an excavation teaching device for a construction machine, which can overcome the above-mentioned first and second problems, and which can realize easy confirmation of a proper target excavation surface and increase the working efficiency during excavation even in work of forming the face of slope in complicated three-dimensional landforms.

A second object of the present invention is to provide an excavation teaching device for a construction machine, which can overcome the above-mentioned first and third problems, and which can realize easy confirmation of a proper target excavation surface, facilitate positioning of a machine body during excavation, and increase the working efficiency even in work of forming the face of slope in complicated three-dimensional landforms.

The term "absolute position in a three-dimensional space" used in this description means a position expressed using a coordinate system set outside a traveling construction machine. In the case of employing the GPS as a three-dimensional positioning system, for example, the "absolute position in a three-dimensional space" means a position expressed using a coordinate system fixed to a standard ellipsoid that is employed as an altitude reference in the GPS. Also, in this description, the coordinate system set to the standard ellipsoid is referred to as a global coordinate system.

Further, the term "plane right coordinate system" means an right coordinate system that is stipulated in the Surveying Acts and defined by dividing the whole of Japan into 19 regions and assuming each region to be a flat plane. Thus, the plane right coordinate system is a three-dimensional right coordinate system having the origin set to a particular place in each of the divided regions. Image data of a three-dimensional target landform used in this description is prepared as values on the plane right coordinate system.

(1) To achieve the above objects, the present invention provides an excavation teaching device for a construction machine for carrying out excavation to shape a three-dimensional landform into a three-dimensional target landform with operation of an operating mechanism for excavation, the excavation teaching device comprising position measuring means for measuring a three-dimensional position of an operating mechanism of the construction machine, and display means for displaying a positional relationship between the three-dimensional target landform and the operating mechanism in accordance with a measured result of the position measuring means, wherein the display means displays, as an image in a first screen area, a plurality of small plane surfaces constituting the three-dimensional target landform and an illustration of the whole or a part of the construction machine including a body of the construction machine and at least a fore end portion of the operating mechanism, and discriminatively displays in the first screen area, as a target excavation surface, one of the plurality of small plane surfaces constituting the three-dimensional target landform, which satisfies that the direction normal to the one small plane surface is parallel within a range of allowable error to a plane in which the operating mechanism operates.

Thus, one of the plurality of small plane surfaces constituting the three-dimensional target landform, which satisfies that the direction normal to the one small plane surface is parallel within the range of allowable error to the plane in which the operating mechanism operates, is discriminatively displayed as the target excavation surface. Even in complicated three-dimensional landforms where the landform along which excavation is to be performed changes with movement of the construction machine, therefore, the operator can easily confirm the target excavation surface corresponding to the current position of the construction machine, and hence the working efficiency during excavation can be increased.

(2) In above (1), preferably, the display means displays, as an image in a second screen area representing a cross-sectional view taken along a plane in which the operating mechanism operates, an intersect line between the plane in which the operating mechanism operates and the plurality of small plane surfaces, and the illustration of the whole or a part of the construction machine concurrently with the image in the first screen area.

(3) In above (1), preferably, when there are a plurality of target excavation surfaces, the display means discriminately displays one of the target excavation surfaces which has the shortest distance from the direction normal to the one target excavation surface to the plane in which the operating mechanism operates.

(4) In above (1), preferably, when there are a plurality of target excavation surfaces, the display means displays the target excavation surfaces in different color tones such that the order in distance from the direction normal to each target excavation surface to the plane in which the operating mechanism operates is represented from the nearest to farthest target excavation surface.

(5) In above (1), preferably, the excavation teaching device further comprises switching means for making switching-over from an automatic setting mode to a manual setting mode in selection of the target excavation surface, wherein when the manual setting mode is selected by the switching means, the display means discriminatively displays the small plane surface selected by an operator.

(6) In above (1), preferably, the display means discriminatively displays one or more of plurality of small plane surfaces constituting the three-dimensional target landform which are positioned within a predetermined distance from the construction machine.

(7) In above (1), preferably, when none of the plurality of small plane surfaces constituting the three-dimensional target landform satisfies that the direction normal to each small plane surface is parallel within the range of allowable error to the plane in which the operating mechanism operates, the display means displays a message indicating the absence of the relevant small plane surfaces.

(8) In above (1), preferably, the display means displays the plurality of small plane surfaces constituting the three-dimensional target landform and the illustration of the whole or a part of the construction machine including at least the fore end portion of the operating mechanism, and further displays, in the first screen area, a line resulting from projecting a line normal to the target excavation surface, selected from among the plurality of small plane surfaces constituting the three-dimensional target landform, on a horizontal plane and the direction in which the operating mechanism of the construction machine operates with current orientation thereof.

(9) In above (8), preferably, the display means concurrently displays, in the first screen area, a center position of the body of the construction machine.

(10) In above (8), preferably, the display means displays, as an image in the second screen area representing a cross-sectional view taken along a plane in which the operating mechanism operates, an intersect line between the plane in which the operating mechanism operates and the plurality of small plane surfaces, and the illustration of the whole or a part of the construction machine concurrently with the image in the first screen area.

(11) In above (8), preferably, the display means concurrently displays, in the first screen area, a line representing the direction in which a travel body of the construction machine is moved.

(12) Also, to achieve the above objects, the present invention provides an excavation teaching device for a construction machine for carrying out excavation to shape a three-dimensional landform into a three-dimensional target landform with operation of an operating mechanism for excavation, the excavation teaching device comprising position measuring means for measuring a three-dimensional position of an operating mechanism of the construction machine, and display means for displaying a positional relationship between the three-dimensional target landform and the operating mechanism in accordance with a measured result of the position measuring means, wherein the display means displays, as an image in a first screen area, a plurality of small plane surfaces constituting the three-dimensional target landform and an illustration of the whole or a part of the construction machine including at least a fore end portion of the operating mechanism, and further displays, in the first screen area, a line resulting from projecting a line normal to a target excavation surface, selected from among the plurality of small plane surfaces constituting the three-dimensional target landform, on a horizontal plane and the direction in which the operating mechanism of the construction machine operates with current orientation thereof.

Thus, the projected line of the line normal to the target excavation surface and the direction in which the operating mechanism of the construction machine operates with current orientation thereof are displayed on the same screen. Even in complicated three-dimensional landforms where the landform along which excavation is to be performed changes with movement of the construction machine, therefore, the operator can intuitively easily confirm the position of the construction machine suitable for excavation to follow the target excavation surface, and hence the working efficiency during excavation can be increased.

(13) In above (12), preferably, the display means concurrently displays, in the first screen area, a center position of a body of the construction machine.

(14) In above (12), preferably, the display means displays, as an image in a second screen area representing a cross-sectional view taken along a plane in which the operating mechanism operates, an intersect line between the plane in which the operating mechanism operates and the plurality of small plane surfaces, and the illustration of the whole or a part of the construction machine concurrently with the image in the first screen area.

(15) In above (12), preferably, the display means concurrently displays, in the first screen area, a line representing the direction in which a travel body of the construction machine is moved.

BEST MODE FOR CARRYING OUT THE INVENTION

With reference to FIGS. 1 to 13, a description will be made below of the case in which an excavation teaching device for a construction machine according to one embodiment of the present invention is applied to a hydraulic excavator.

Figure 1:
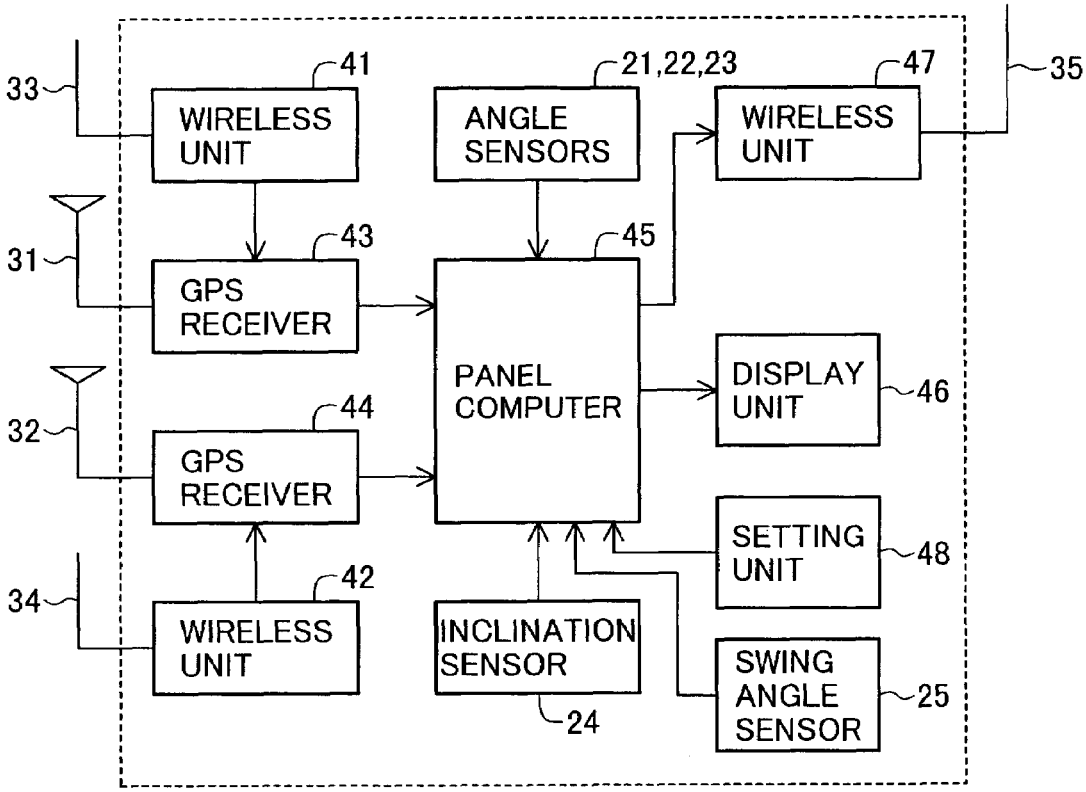
FIG. 1 is a block diagram showing the configuration of a work position measuring system employing an excavation teaching device for a construction machine according to one embodiment of the present invention.

FIG. 1 is a block diagram showing the configuration of a work position measuring system employing an excavation teaching device for a construction machine according to one embodiment of the present invention.

The work position measuring system comprises wireless units 41, 42 for receiving reference data (described later) from a reference station via antennas 33, 34; GPS receivers 43, 44 for measuring respective three-dimensional positions of GPS antennas 31, 32 in real time based on the reference data received by the wireless units 41, 42 and a signal from a GPS satellite received by each of the GPS antennas 31, 32; a panel computer 45 for computing the position of a fore end (monitoring point) of a bucket 7 of a hydraulic excavator 1 based on position data from the GPS receivers 43, 44 and angle data from various sensors, such as angle sensors 21, 22 and 23, an inclination sensor 24 and a swing angle sensor 25, the panel computer 45 storing later-described data representing a three-dimensional target landform in a predetermined memory; a display unit 46 for displaying the position data computed by the panel computer 45 and the three-dimensional target landform together with illustrations, etc.; a wireless unit 47 for transmitting the position data computed by the panel computer 45 via an antenna 35; and a setting unit 48 for setting and instructing which one of a plurality of small plane surfaces selected by the panel computer 45 is to be set as a target excavation surface. A pair of the GPS antenna 31 and the GPS receiver 43 and a pair of the GPS antenna 32 and the GPS receiver 44 each constitutes one set of GPS (Global Positioning System).

Figure 2:
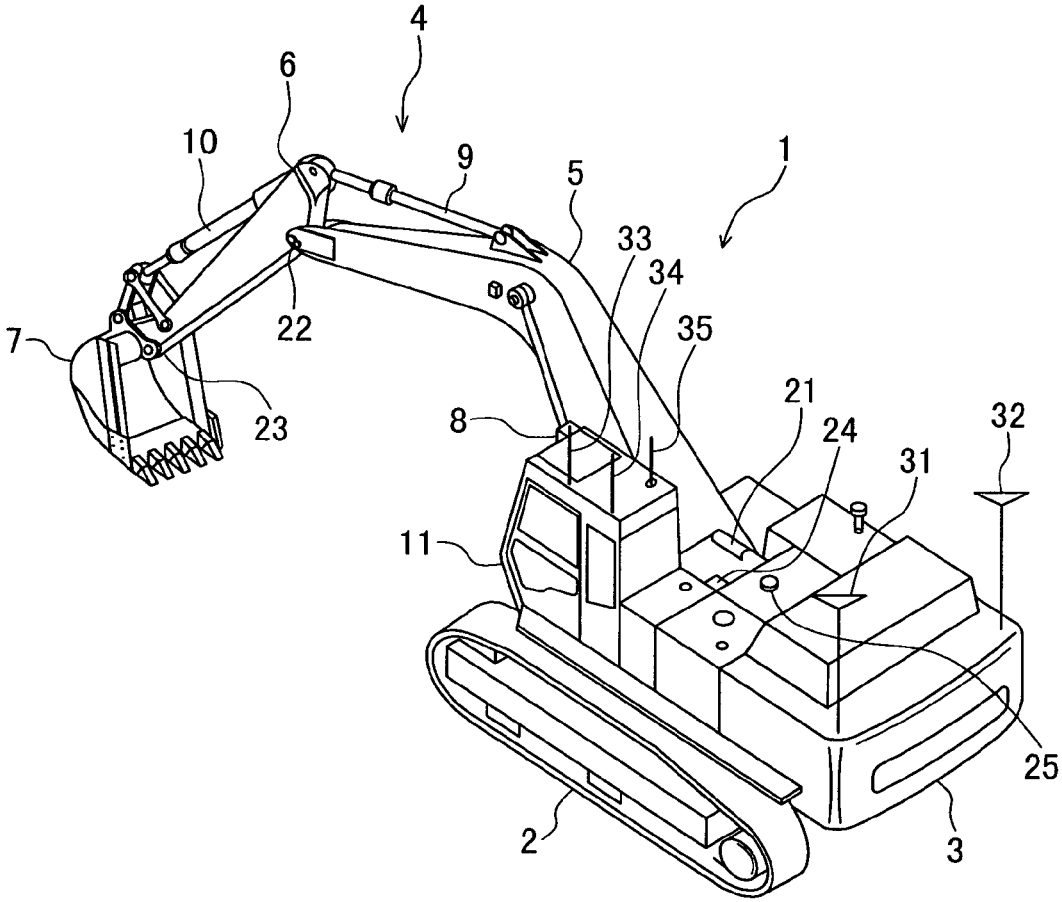
FIG. 2 shows an outward appearance of a hydraulic excavator equipped with the work position measuring system employing according to one embodiment of the present invention.

FIG. 2 shows an outward appearance of a hydraulic excavator employing the excavation teaching device for the construction machine according to the embodiment of the present invention.

The hydraulic excavator 1 comprises a lower travel structure 2, an upper swing body 3 swingably mounted to the lower travel structure 2 and constituting a machine body together with the lower travel structure 2, and a front operating mechanism 4 mounted to the upper swing body 3. The front operating mechanism 4 comprises a boom 5 vertically rotatably mounted to the upper swing body 3, an arm 6 vertically rotatably mounted to a fore end of the boom 5, and a bucket 7 vertically rotatably mounted to a fore end of the arm 6. The boom 5, the arm and the bucket 7 are driven respectively with extension and contraction of a boom cylinder 8, an arm cylinder 9 and a bucket cylinder 10. A cab 11 is provided on the upper swing body 3.

The hydraulic excavator 1 is provided with an angle sensor 21 for detecting a rotational angle of the boom 5 relative to the upper swing body 3 (i.e., a boom angle), an angle sensor 22 for detecting a rotational angle of the arm 6 relative to the boom 5 (i.e., an arm angle), an angle sensor 23 for detecting a rotational angle of the arm 6 relative to the bucket 7 (i.e., a bucket angle), an inclination sensor 24 for detecting an inclination angle of the upper swing body 3 in the longitudinal direction (i.e., a pitch angle), and a swing angle sensor 25 for detecting a rotational angle of the upper swing body 3 relative to the lower travel structure 2 (i.e., a swing angle).

Further, the hydraulic excavator 1 is provided with the two GPS antennas 31, 32 for receiving the signal from the GPS satellite, the wireless antennas 33, 34 for receiving reference data (described later) transmitted from a base station, and the wireless antenna 35 for transmitting position data. The two GPS antennas 31, 32 are installed respectively in rear left and right corners of the upper swing body 3 offset from the center about which the upper swing body 3 swings.

Figure 3:
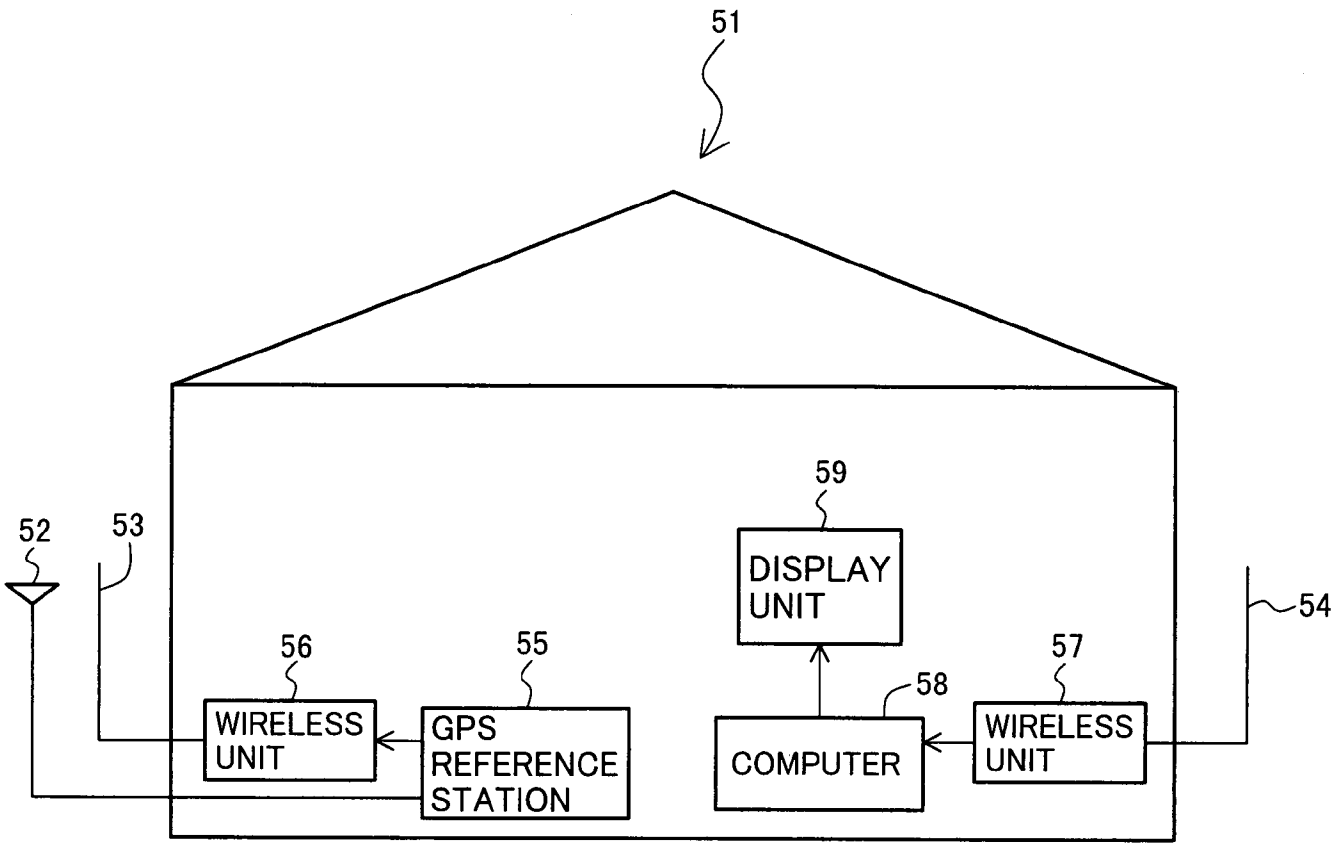
FIG. 3 is a block diagram showing the configuration of an office-side system serving as a GPS reference station.

FIG. 3 is a block diagram showing the configuration of an office-side system serving as a GPS reference station.

An office 51 for managing the positions and operations of the hydraulic excavator 1, the bucket 7, etc. includes a GPS antenna 52 for receiving the signal from the GPS satellite; a wireless antenna 53 for transmitting the reference data to the hydraulic excavator 1; a wireless antenna 54 for receiving, from the hydraulic excavator 1, the position data of the hydraulic excavator 1, the bucket 7, etc.; a GPS receiver 55 serving as a GPS reference station for producing reference data, which is used by the GPS receivers 43, 44 of the hydraulic excavator 1 for RTK (real time kinematic) measurement, based on three-dimensional position data measured in advance and the signal from the GPS satellite received by the GPS antenna 52; a wireless unit 56 for transmitting the reference data produced by the GPS receiver 55 via an antenna 53; a wireless unit 57 for receiving the position data via the antenna 54; a computer 58 for executing processing to display and manage the positions of the hydraulic excavator 1, the bucket 7, etc. based on the position data received by the wireless unit 57, and to display data representing the three-dimensional target landform; and a display unit 59 for displaying the position data and management data computed by the computer 58, and the three-dimensional target landform together with illustrations, etc. The GPS antenna 52 and the GPS receiver 55 constitute one set of GPS.

The principles of operation of the work position measuring system according to this embodiment will be described below. In this embodiment, to perform the position measurement at high accuracy, each of the GPS receivers 43, 44 shown in FIG. 1 executes the RTK measurement. The GPS reference station 55 for producing the reference data, shown in FIG. 3, is required prior to executing the RTK measurement. The GPS reference station 55 produces the reference data for the RTK measurement, as mentioned above, based on the position data of the antenna 52 three-dimensionally measured in advance and the signal from the GPS satellite received by the antenna 52. The produced reference data is transmitted from the wireless unit 56 at a certain cycle via the antenna 53.

On the other hand, the GPS receivers 43, 44 equipped on the excavator, shown in FIG. 1, obtain the three-dimensional positions of the antennas 31, 32 through RTK measurements based on the reference data received by the wireless units 41, 42 via the antennas 33, 34 and the signal from the GPS satellite received by each of the antennas 31, 32. The RTK measurements enable the three-dimensional positions of the antennas 31, 32 to be measured at accuracy of about ±1 to 2 cm. The measured three-dimensional position data is then inputted to the panel computer 45.

Further, the inclination sensor 24 measures the pitch angle of the hydraulic excavator 1, and the angle sensors 21 to 23 measure the respective angles of the boom 5, the arm 6 and the bucket 7. The measured data is also inputted to the panel computer 45.

Based on the position data from the GPS receivers 43, 44 and the angle data from the various sensors 21 to 24, the panel computer 45 executes general vector operations and coordinate transforms, thereby computing the three-dimensional position of the fore end of the bucket 7.

Figure 4:
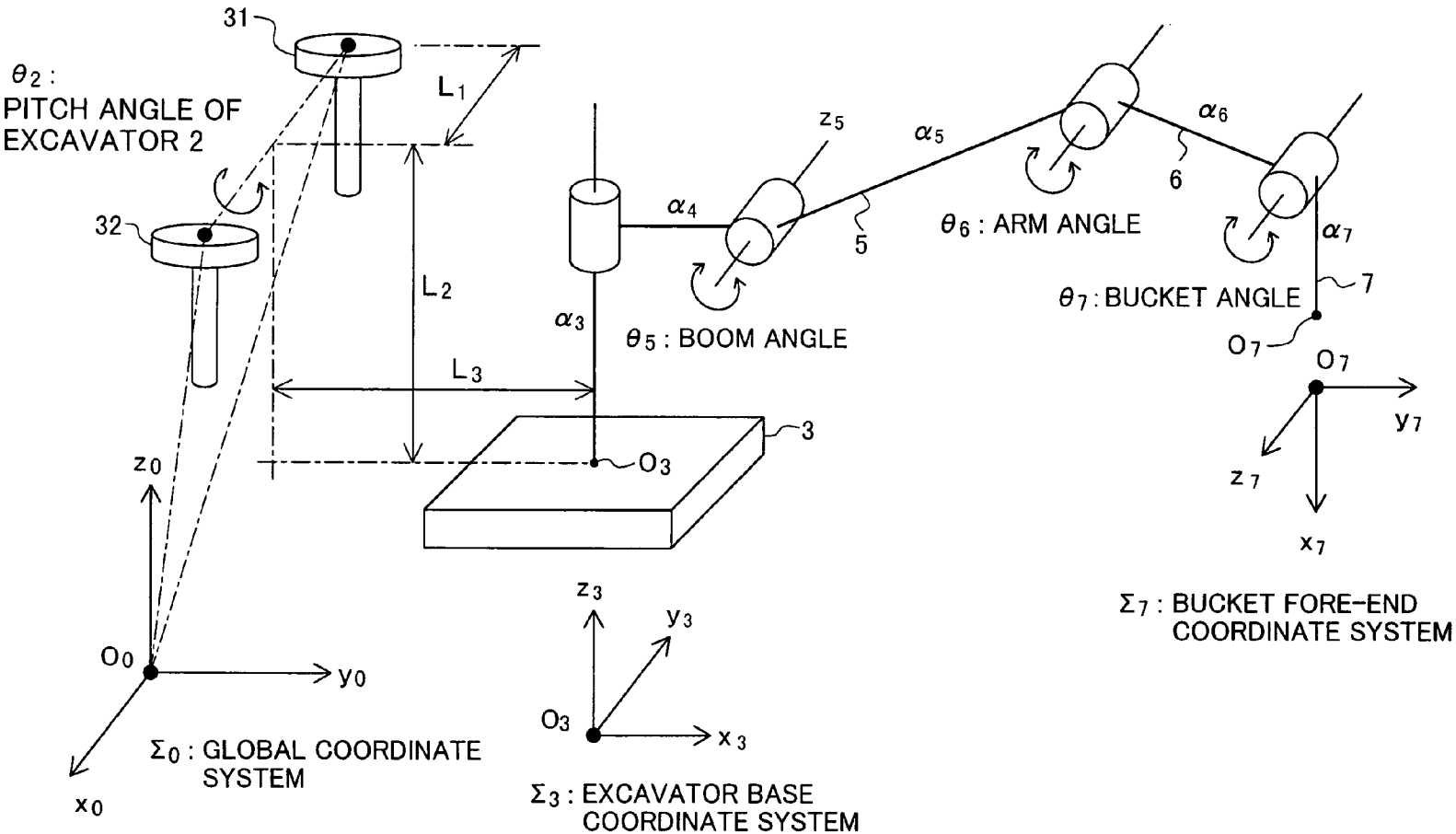
FIG. 4 shows coordinate systems used for computing an absolute position of a fore end of a bucket in a three-dimensional space.

The three-dimensional position processing executed in the panel computer 45 will be described below with reference to FIG. 4 to 6. FIG. 4 shows coordinate systems used for computing an absolute position of the fore end of the bucket 7 in a three-dimensional space. In FIG. 4, $\Sigma 0$ represents a global coordinate system having the origin O0 at the center of the reference ellipsoid in the GPS. Also, $\Sigma 3$ represents an excavator base coordinate system that is fixed to the upper swing body 3 of the hydraulic excavator 1 and has the origin O3 at a cross point between a swing base frame and the swing center. Further, $\Sigma 7$ represents a bucket fore-end coordinate system that is fixed to the bucket 7 and has the center O7 at the fore end of the bucket 7.

Positional relationships L1, L2 and L3 of the GPS antennas 31, 32 relative to the origin (cross point between the swing base frame and the swing center) O3 of the excavator base coordinate system $\Sigma 3$ are known. Therefore, if the three-dimensional positions of the GPS antennas 31, 32 on the global coordinate system $\Sigma 0$ and a pitch angle $\theta 2$ of the hydraulic excavator 1 are obtained, the position and posture (orientation of the upper swing body 3) of the excavator base coordinate system $\Sigma 3$ on the global coordinate system $\Sigma 0$ can be determined. Also, positional relationships $\alpha 3$, $\alpha 4$ of a base end of the boom 5 relative to the origin (cross point between the swing base frame and the swing center) O3 of the excavator base coordinate system $\Sigma 3$ and respective dimensions $\alpha 5$, $\alpha 6$ and $\alpha 7$ of the boom 5, the arm 6 and the bucket 7 are known. Therefore, if a boom angle $\theta 5$, an arm angle $\theta 6$ and a bucket angle $\theta 7$ are obtained, the position and posture of the bucket fore-end coordinate system $\Sigma 7$ on the excavator base coordinate system $\Sigma 3$ can be determined. Accordingly, the fore end position of the bucket 7 can be determined as values on the global coordinate system $\Sigma 0$ by obtaining, as values on the global coordinate system $\Sigma 0$, the three-dimensional positions of the GPS antennas 31, 32 which have been determined by the excavator equipped GPS receivers 43, 44, obtaining the pitch angle θ2 of the hydraulic excavator 1 by the angle sensor 24, obtaining the boom angle θ5, the arm angle θ6 and the bucket angle θ7 respectively by the angle sensors 21 to 23, and executing coordinate transform processing.

Figure 5:
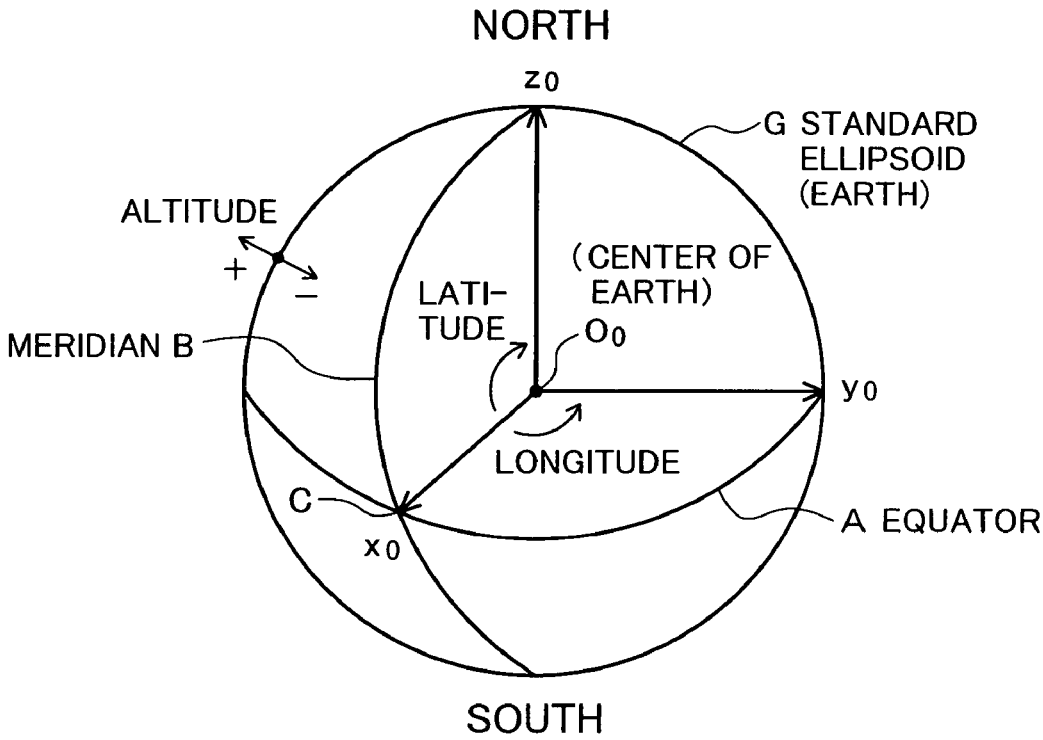
FIG. 5 is an illustration for explaining the basic concept of a global coordinate system.

FIG. 5 is an illustration for explaining the basic concept of the global coordinate system. In FIG. 5, G represents a reference ellipsoid used in the GPS, and the origin O0 of the global coordinate system Σ0 is set to the center of the reference ellipsoid G. Also, an x0 axis of the global coordinate system Σ0 is directed to lie on a line passing a cross point C between the equator A and the meridian B and the center of the reference ellipsoid G. A z0 axis is directed to lie on a line extending from the center of the reference ellipsoid G to the south and the north, and a y0 axis is directed to lie on a line perpendicular to the x0 axis and the z0 axis. In the GPS, a position on the earth is expressed using latitude, longitude, and altitude (height) relative to the reference ellipsoid G. By setting the global coordinate system Σ0 as described above, therefore, position information based on the GPS can be easily converted into values on the global coordinate system Σ0.

Figure 6:
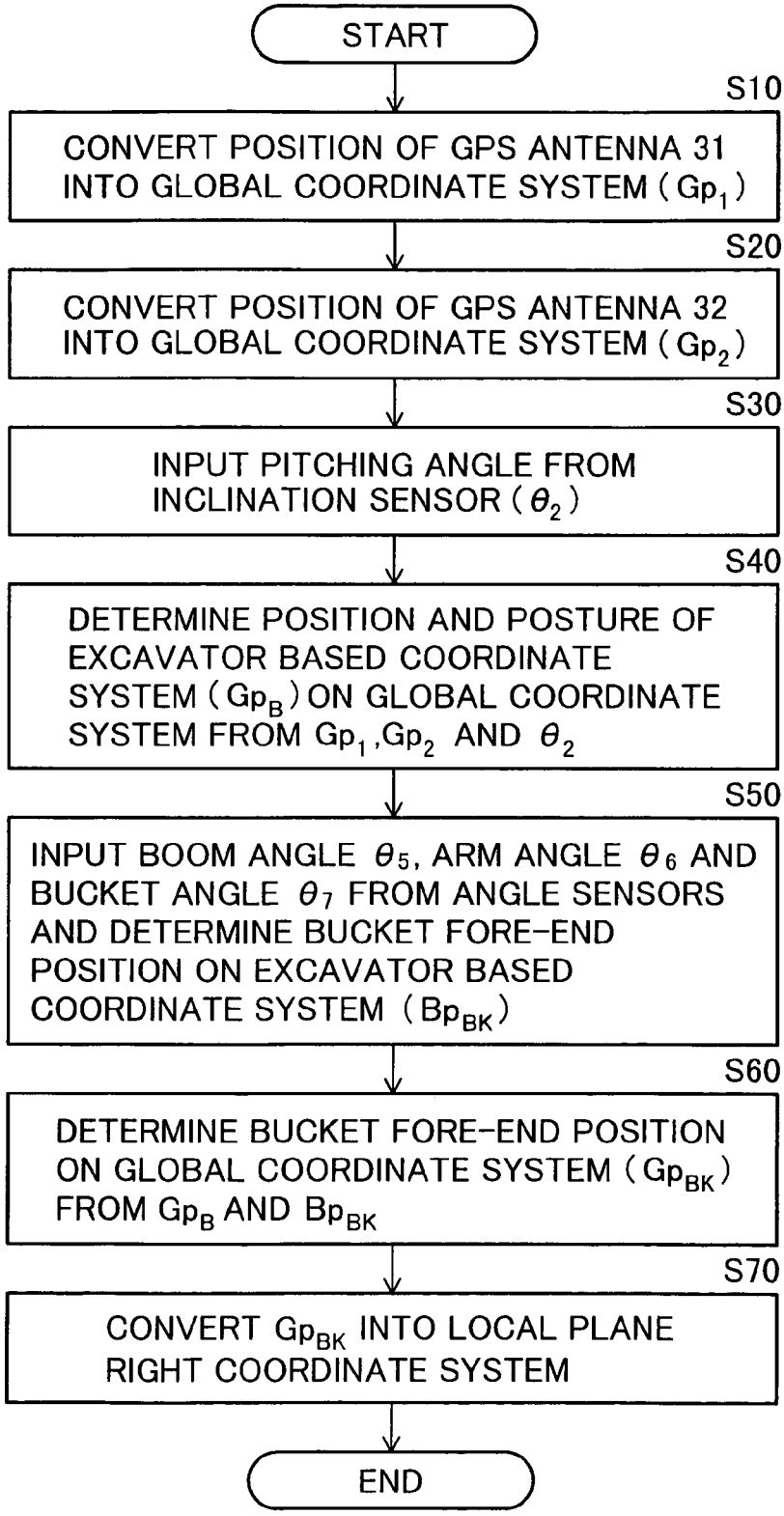
FIG. 6 is a flowchart of three-dimensional position processing steps.

FIG. 6 is a flowchart of three-dimensional position processing steps. In FIG. 6, first, the three-dimensional position (latitude, longitude and altitude) of the GPS antenna 31, which has been determined by the excavator equipped GPS receiver 43, is converted into a value GP1 on the global coordinate system Σ0 in accordance with the above-described concept (step S10). An arithmetic formula for that conversion is generally known and hence omitted here. Similarly, the three-dimensional position of the GPS antenna 32, which has been determined by the excavator equipped GPS receiver 44, is converted into a value GP2 on the global coordinate system Σ0 (step S20). The pitch angle θ2 measured by the inclination sensor 24 is then inputted (step 30). Thereafter, the position and posture (orientation of the upper swing body 3) of the excavator base coordinate system Σ3 are determined as a value GPB on the global coordinate system Σ0 from the three-dimensional positions GP1, GP2 of the GPS antennas 31, 32 on the global coordinate system Σ0 which have been obtained in steps S10, 20, the inputted pitch angle θ2, and the positional relationships L1, L2 and L3 of the GPS antennas 31, 32 relative to the origin (cross point between the swing base frame and the swing center) O3 of the excavator base coordinate system Σ3 which are stored in a memory (step 40). The processing in step 40 is a coordinate transform and hence can be executed using a general mathematical method. Subsequently, after inputting the boom angle θ5, the arm angle θ6 and the bucket angle θ7 detected by the angle sensors 21 to 23, a bucket fore-end position BPBK on the excavator base coordinate system Σ3 is determined from those inputted angle values, the positional relationships α3, α4 of the base end of the boom 5 relative to the origin (cross point between the swing base frame and the swing center) O3 of the excavator base coordinate system Σ3, and the respective dimensions α5, α6 and α7 of the boom 5, the arm 6 and the bucket 7, the values of α3 to α7 being stored in the memory (step S50). The processing in step 50 is also a coordinate transform and hence can be executed using a general mathematical method. Next, a bucket fore-end position GPBK on the global coordinate system Σ0 is determined from the value GPB of the excavator base coordinate system Σ3 on the global coordinate system Σ0, which has been determined in step S40, and the bucket fore-end position BPBK on the excavator base coordinate system Σ3, which has been determined in step S50 (step S60). The bucket fore-end position GPBK on the global coordinate system Σ0 is then converted into a plane right coordinate system. An arithmetic formula for that conversion is generally known and hence omitted here.

The absolute position of the fore end of the bucket 7 in the three-dimensional space can be determined through the processing described above.

The three-dimensional position of the bucket fore end thus determined is transmitted from the wireless unit 47 via the antenna 35. The transmitted position data of the fore end of the bucket 7 is received by the wireless unit 57 via the antenna 54 and inputted to the computer 58. The computer 58 stores the inputted position data of the fore end of the bucket 7 and, like the panel computer 45, it displays illustrations of the body and the bucket of the hydraulic excavator on a monitor of the display unit 59 at respective three-dimensional positions on the three-dimensional target landform stored in the predetermined memory in advance. As a result, the working status of the hydraulic excavator 1 can be managed in the office 51.

Display examples of images displayed on a display screen of the display unit 46 are shown in FIGS. 7 to 10.

Figure 7:
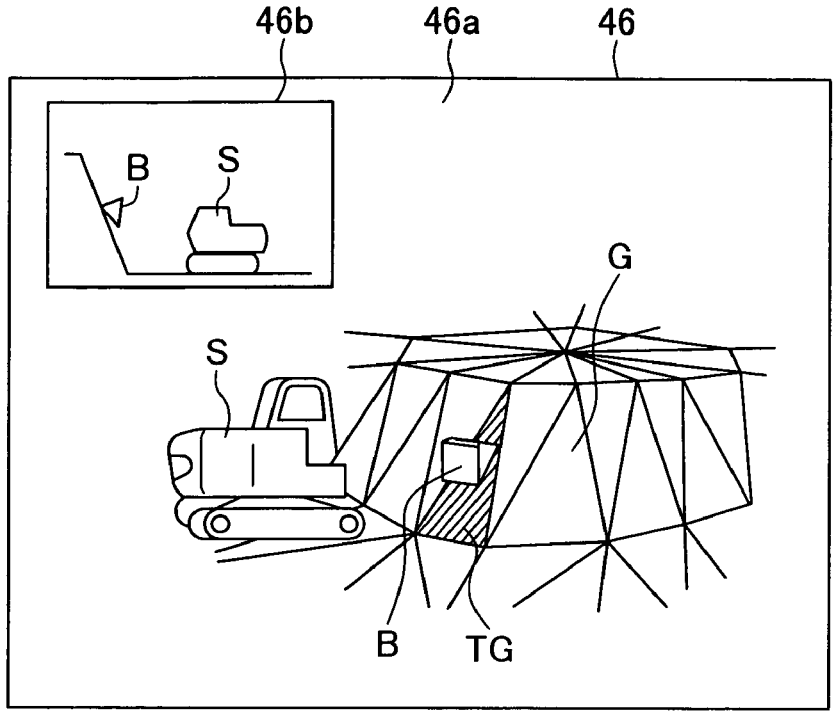
FIG. 7 shows a first position display example displayed on a display screen of a display unit.

FIG. 7 shows a first position display example displayed on the display screen of the display unit 46. The display unit 46 displays images in a first screen area 46*a* and a second screen area 46*b*. The first screen area 46*a* displays illustrations of the body S of the hydraulic excavator and the bucket B as an excavating tool at the fore end of the operating mechanism, as shown in FIG. 7, at respective three-dimensional positions on the three-dimensional target landform G, which is stored in the predetermined memory in advance, by using the three-dimensional positions determined through the three-dimensional position processing executed in the panel computer 45. Also, a target excavation surface TG (hatched in the drawing) taught by the excavation teaching device of this embodiment is displayed in a different color from that of other excavation surfaces. The image displayed on the display unit 46 can be changed to another one looking from any desired viewing point with the operation of the setting unit 48.

Further, the panel computer 45 computes a three-dimensional intersect line between a plane defining a vertical cross-section extending in the same direction as the orientation of the bucket (i.e., a plane in which the bucket operates or a plane fixed to the upper swing body in which the bucket operates with the operation of the front operating mechanism) and the three-dimensional target landform, and displays the computed intersect line as the image in the second screen area 46*b* together with the machine body S and the bucket B, thereby informing an operator of the working status.

With such simultaneous presentation of both the three-dimensional position display and cross-sectional display, the positional relationships of the machine body S and the bucket B relative to the target excavation surface TG can be displayed so that the operator may intuitively recognize those positional relationships.

Figure 8:
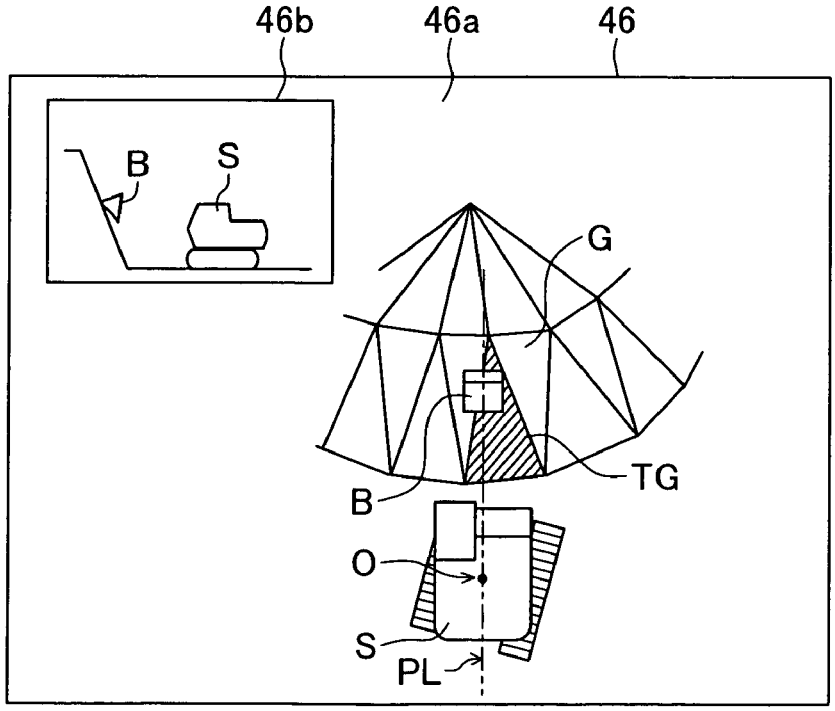
FIG. 8 shows a second position display example displayed on the display screen of the display unit.

FIG. 8 shows a second position display example displayed on the display screen of the display unit 46. The first screen area 46*a* displays a two-dimensional image as viewed from above. On condition that a direction PL in which the bucket of the hydraulic excavator operates with the current orientation thereof (i.e., a straight line resulting when viewing from above the plane in which the bucket operates) and a direction normal to each of small plane surfaces constituting the three-dimensional target landform are deviated from each other within a preset range of error, the panel computer 45 automatically selects one small plane surface satisfying that the direction PL of the bucket operation and a line GL resulting from projecting a line normal to the selected small plane surface on a horizontal plane are substantially parallel to each other, and then sets the selected small plane surface as the target excavation surface TG. The center O about which the body S of the hydraulic excavator swings is also displayed on the screen image.

Figure 9:
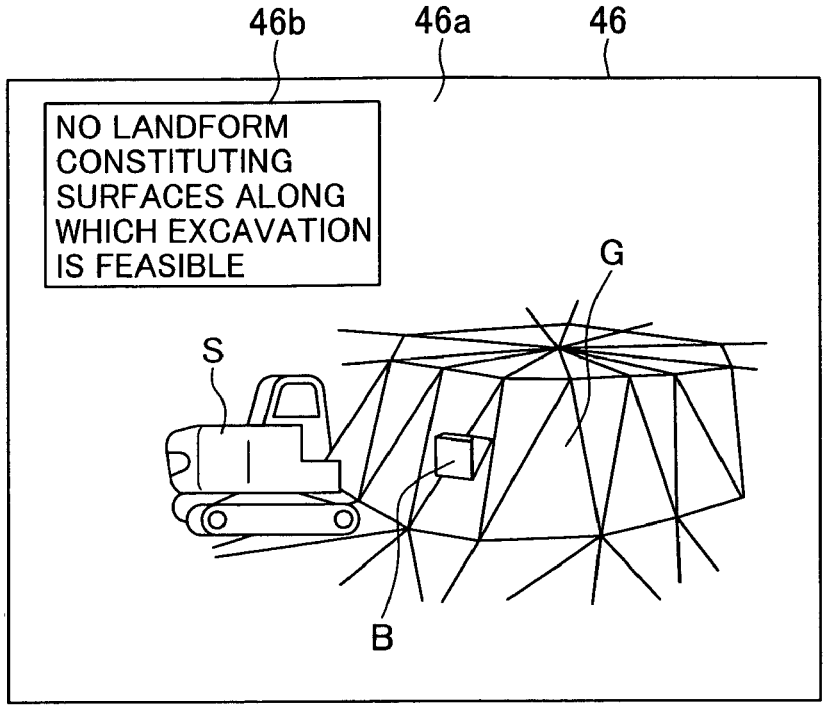
FIG. 9 shows a third position display example displayed on the display screen of the display unit.

FIG. 9 shows a third position display example displayed on the display screen of the display unit 46. When there are no small plane surfaces constituting the three-dimensional target landform and satisfying that the plane in which the bucket operates and the direction normal to each of those small plane surfaces are parallel to each other within the preset range of error, the panel computer 45 displays, in the second screen area 46*b* of the display unit 46, a message "No landform constituting surfaces along which excavation is feasible". In addition, at this time, because the target excavation surface cannot be selected, the target excavation surface TG shown in FIG. 7 is not displayed in the first screen area 46*a*.

Figure 10:
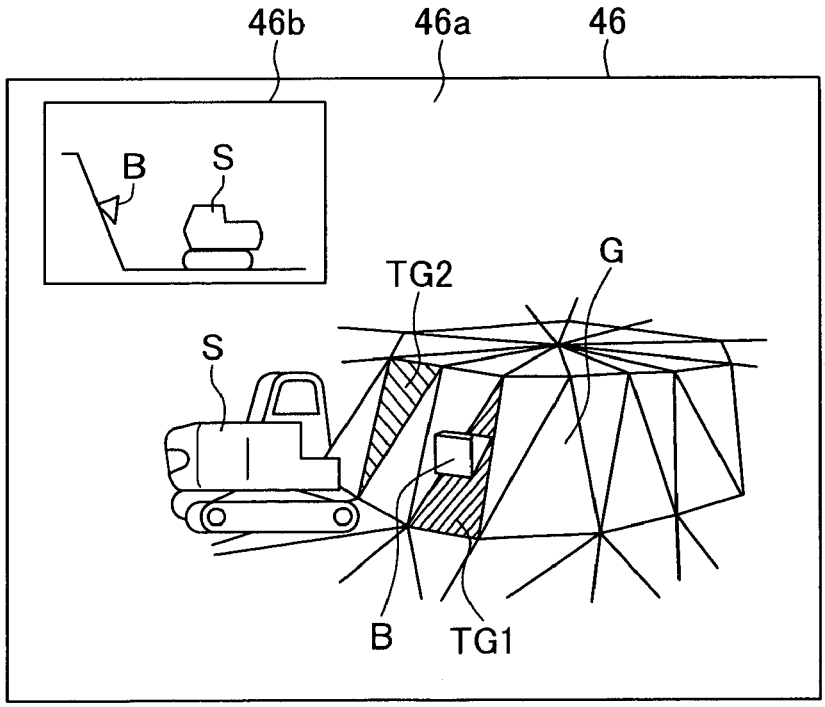
FIG. 10 shows a fourth position display example displayed on the display screen of the display unit.

FIG. 10 shows a fourth position display example displayed on the display screen of the display unit 46. When there are a plurality of small plane surfaces. constituting the three-dimensional target landform and satisfying that the plane in which the bucket operates and the direction normal to each of those small plane surfaces are parallel to each other within the preset range of error, the first screen area 46*a* displays a plurality of such landform constituting surfaces TG1, TG2 in different colors. At this time, the colors are changed depending on the distances from the position of the machine body to the respective small plane surfaces. For example, color tones are changed such that the color of the nearest landform constituting surface TG1 is darker than the color of the landform constituting surface TG2 farther away from TG1, thus enabling the operator to discern at a glance which one of the landform constituting surfaces is nearest. While the number of the landform constituting surfaces is two in the shown example, three or more landform constituting surfaces are also similarly displayed in different colors for discrimination.

Figure 11:
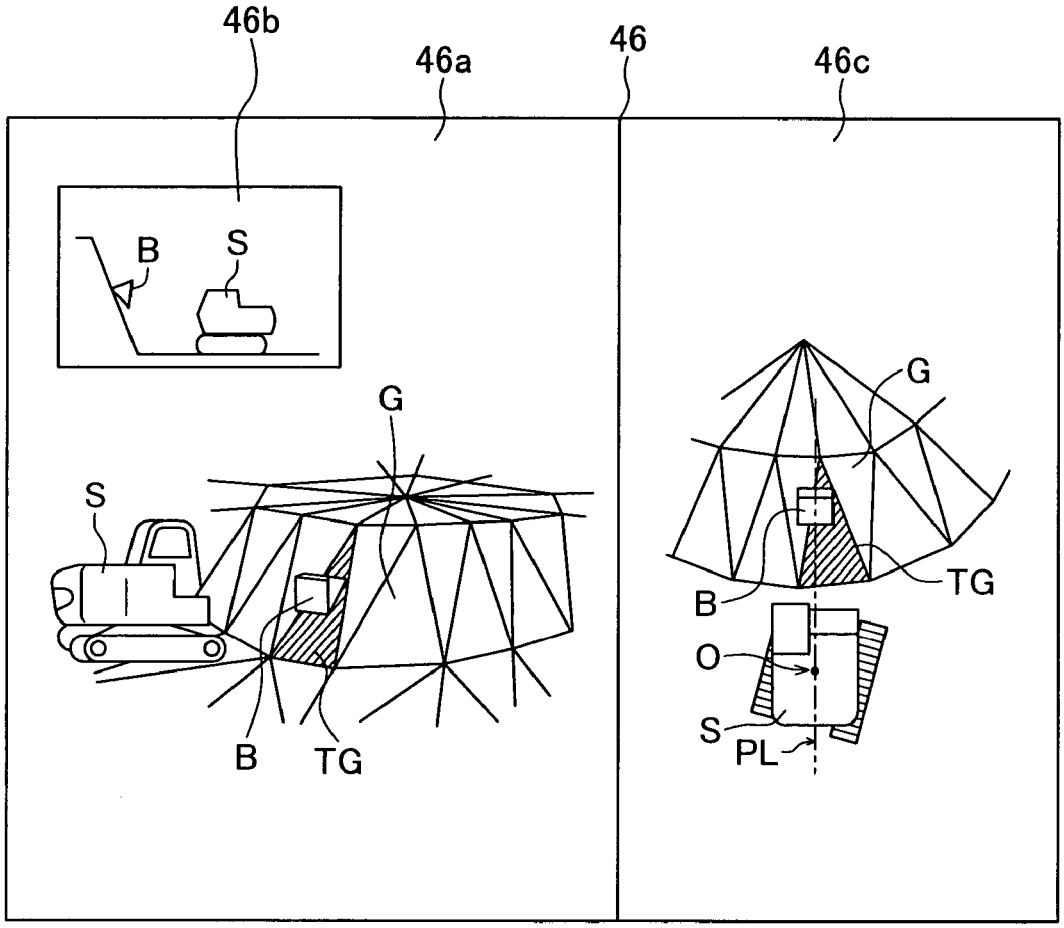
FIG. 11 shows a fifth position display example displayed on the display screen of the display unit.

FIG. 11 shows a fifth position display example displayed on the display screen of the display unit 46. The display screen of the display unit 46 is divided into left and right areas. The left area includes the first screen area 46*a* and the second screen area 46*b*, while the right area forms a third screen area 46*c*. Similarly to FIG. 7, the first screen area 46*a* displays the illustrations of the body S and the bucket B of the hydraulic excavator, as shown in FIG. 7, at respective three-dimensional positions on the three-dimensional target landform G, which is stored in the predetermined memory in advance, by using the three-dimensional positions determined through the three-dimensional position processing executed in the panel computer 45.

Also, as in FIG. 7, the second screen area 46*b* displays the three-dimensional intersect line between the plane defining the vertical cross-section extending in the same direction as the orientation of the bucket and the three-dimensional target landform, together with the machine body S and the bucket B.

Further, the third screen area 46*c* displays the two-dimensional image viewing the site from above, as in FIG. 8.

Figure 12:
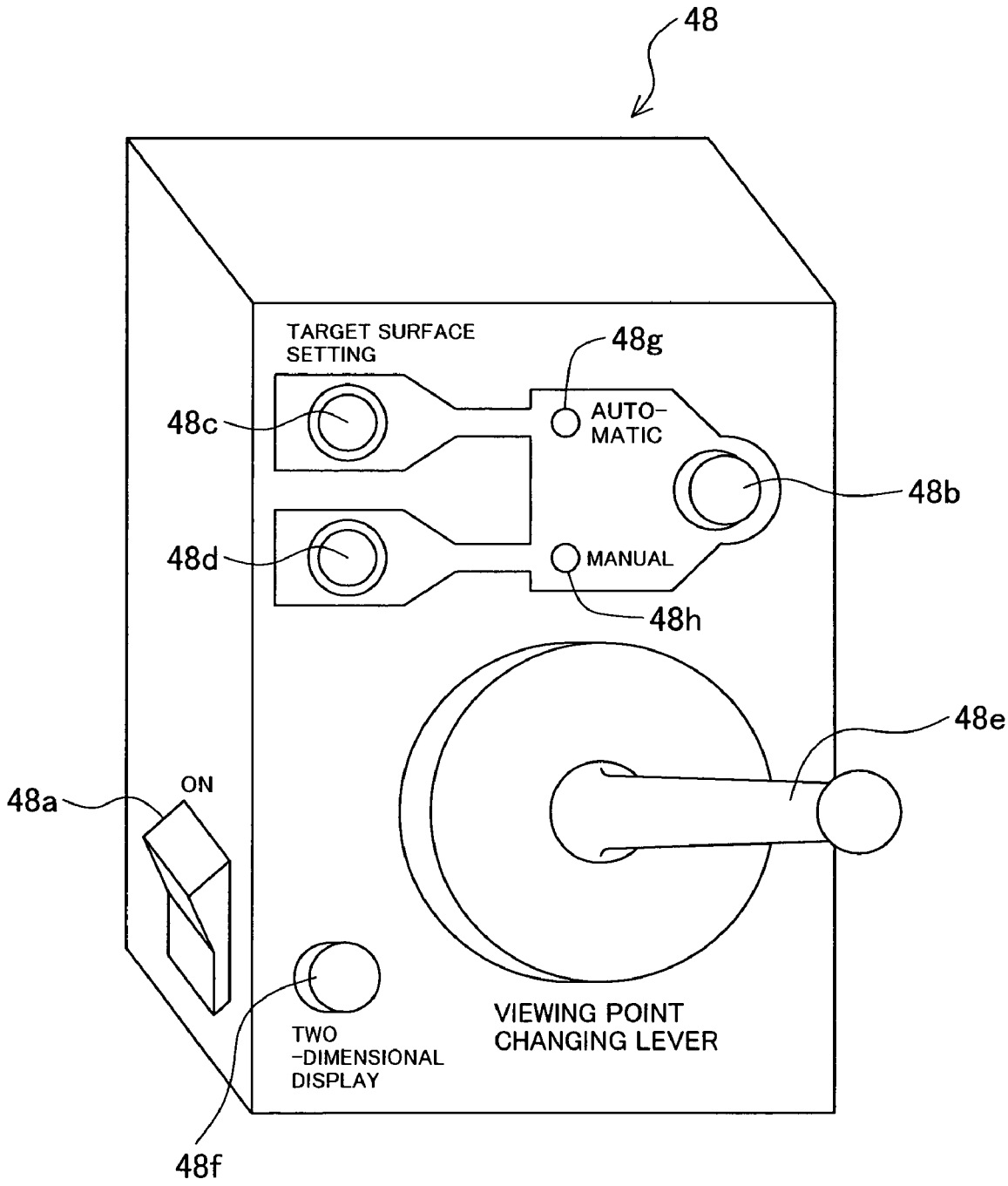
FIG. 12 is perspective view showing an outward appearance of a setting unit used in one embodiment of the present invention.

FIG. 12 is perspective view showing an outward appearance of the setting unit 48 used in this embodiment. The setting unit 48 has a switch 48*a* for turning on/off the start of display on the display unit 46; an automatic/manual switch 48*b* for switching over whether the target excavation surface is automatically taught or manually set; a target excavation surface selecting switch 48*c* for enabling direct teaching to start when the bucket is moved to an excavation surface along which the excavation is to be carried out and the switch 48*c* is depressed in an automatic teaching mode; a manual setting switch 48*d* for manually setting the target excavation surface in a manual setting mode; a joystick 48*e* for moving the viewing point in three-dimensional display; and a two-dimensional display switch 48*f* for switching over the screen image on the display unit to two-dimensional display viewing the site from above as shown in FIG. 8. When the automatic/manual switch 48*b* is depressed once, for example, the automatic teaching mode is selected and an LED 48*g* is turned on. When it is depressed once more, the mode is switched over to the manual setting and an LED 48*h* is turned on.

The processing functions of the panel computer. 45 constituting the excavation surface teaching device of this embodiment will be described below with reference to flowcharts shown in FIGS. 13 to 16.

When displaying the illustrations of the body and the bucket of the hydraulic excavator, as shown in FIG. 7, at respective three-dimensional positions on the three-dimensional target landform stored in the predetermined memory in advance, the panel computer 45 automatically selects one of the small plane surfaces constituting the three-dimensional target landform, which satisfies that the direction in which the bucket of the hydraulic excavator operates with the current orientation thereof and the direction normal to the relevant small plane surface are parallel to each other within the preset range of error, and then sets the selected small plane surface as the target excavation surface.

When operating the bucket to carry out excavation along the target excavation surface, unless the plane in which the bucket operates and a line perpendicular to the target excavation surface are substantially parallel to each other, an edge of the bucket may dig into the target excavation surface or may float from the target excavation surface because the bucket has a certain transverse width. In view of such a problem, the present invention is designed to automatically select one of the small plane surfaces constituting the three-dimensional target landform, which satisfies that the direction in which the bucket of the hydraulic excavator operates with the current orientation thereof and the direction normal to the relevant small plane surface are parallel to each other within the preset range of error, i.e., a surface along which excavation is feasible by the hydraulic excavator in the current posture thereof. Accordingly, the operator is released from the operation of setting the target excavation surface.

Figure 13:
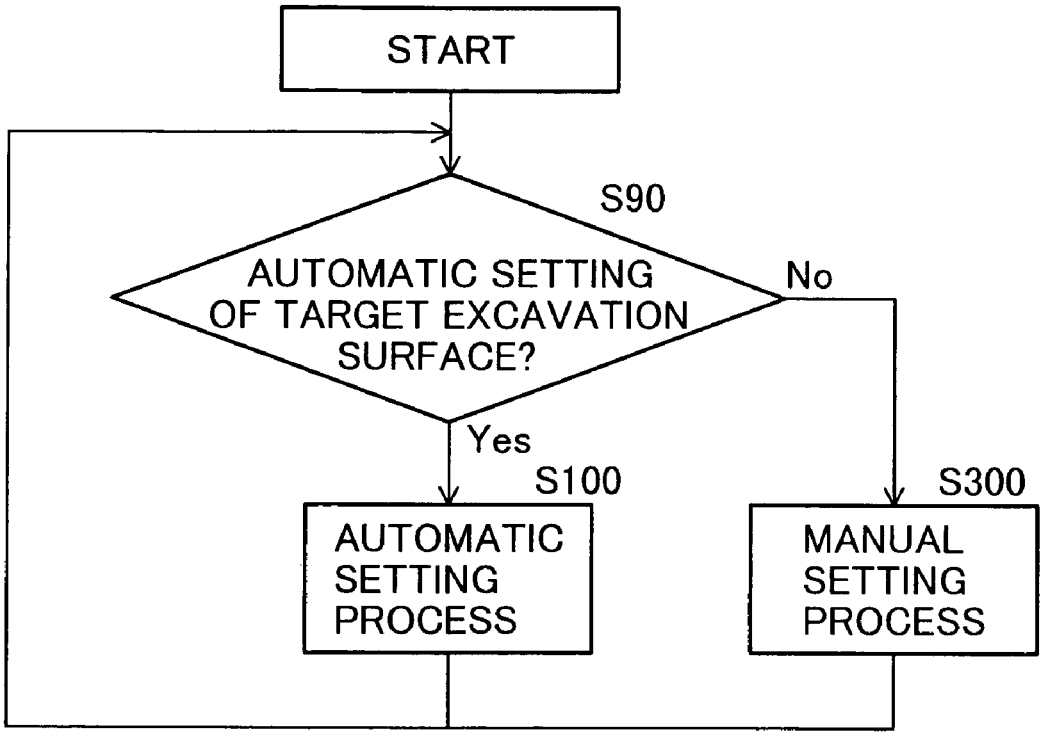
FIG. 13 is a flowchart showing the processing function of a panel computer serving as an excavation surface teaching device according to one embodiment of the present invention.

In FIG. 13, it is determined whether the automatic setting of the target excavation surface is selected (step S90). When the automatic setting is selected with the operation of the automatic/manual switch 48*b* of the setting unit 48 shown in FIG. 11, an automatic setting process is executed (step S100). Details of the automatic setting process will be described below with reference to FIG. 14. When the manual setting is selected, a manual setting process is executed (step S300). Details of the manual setting process will be described later with reference to FIG. 16.

Figure 14:
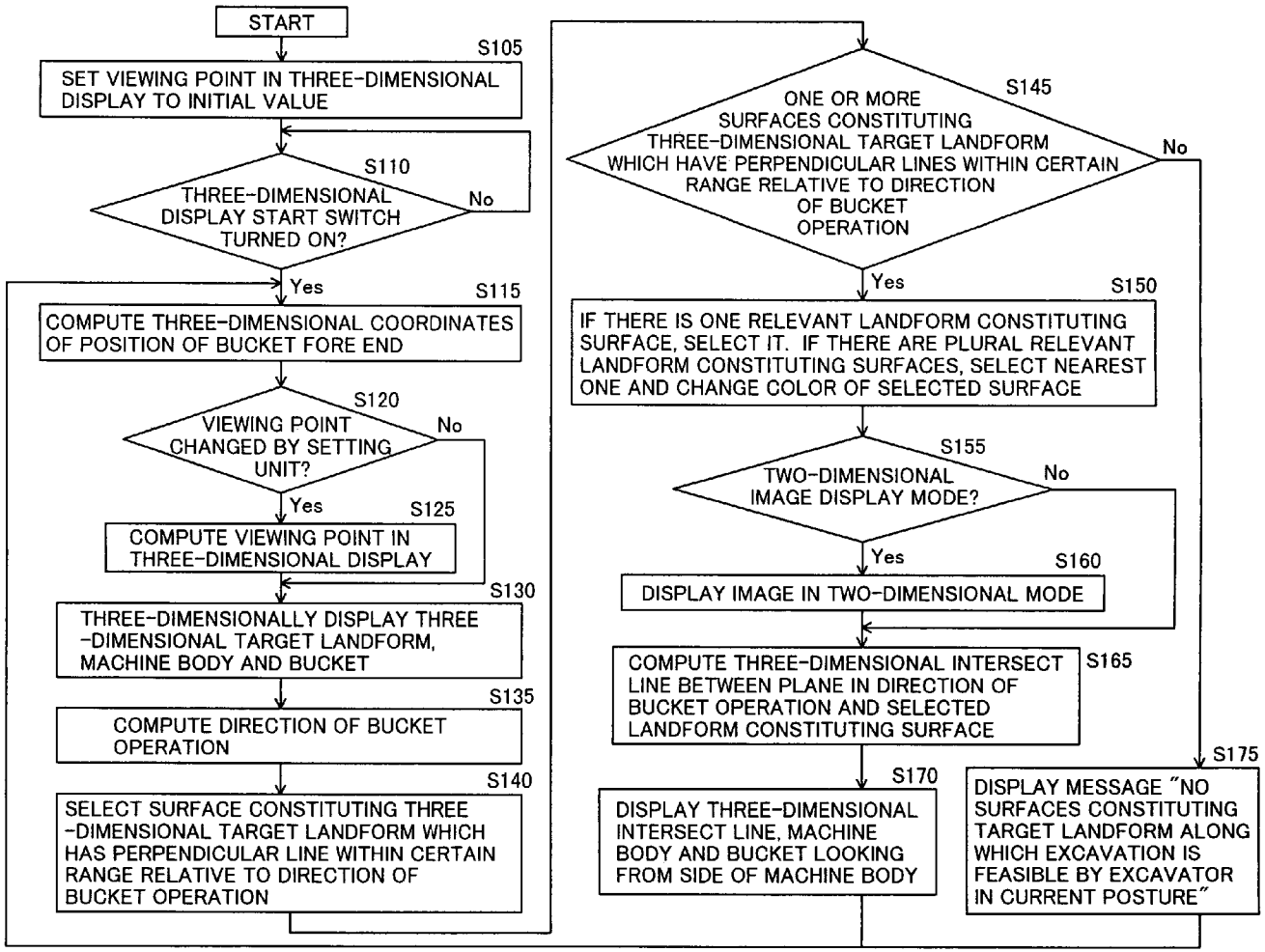
FIG. 14 is a flowchart showing the processing function of the panel computer serving as the excavation surface teaching device according to one embodiment of the present invention.

The details of the automatic setting process for the target excavation surface are described with reference to FIG. 14. Referring to FIG. 14, the panel computer 45 sets the viewing point in three-dimensional display to an initial value (step S105). Then, the panel computer 45 determines whether the three-dimensional display start switch 48*a* of the setting unit 48 is turned on (step S110), and proceeds to step S115 if the switch 48*a* is turned on. The panel computer 45 obtains the position data of the antennas 31, 32 from the GPS receivers 43, 44 and computes three-dimensional coordinates of the fore end position of the bucket 7 in the same manner as that described above with reference to FIGS. 4 to 6 (step S115). Details of steps S105, S100 are as per described in connection with steps S10 to S70 of FIG. 6.

Then, the panel computer determines whether the viewing point has been changed with the operation of the joystick 48*e* of the setting unit 48 (step S120). If changed, it computes the viewing point in three-dimensional display with respect to the position to which the viewing point has been changed (step S125). Subsequently, three-dimensional display of the three-dimensional target landform G, the machine body S and the bucket B is presented on the display screen of the display unit 48 as shown in FIG. 7 (step S130).

Then, the panel computer computes the direction of the bucket operation (step S135). Subsequently, it selects surfaces of the three-dimensional target landform which have perpendicular lines within a certain range relative to the direction of the bucket operation (step S140). Details of the processing of step S140 will be described later with reference to FIG. 15.

Then, the panel computer determines whether there are one or more surfaces of the three-dimensional target landform which have perpendicular lines within the certain range relative to the direction of the bucket operation (step S145). When there is one landform constituting surface satisfying the above condition, that landform constituting surface is selected. When there are plural landform constituting surfaces satisfying the above condition, the panel computer puts the order of priority to those plural landform constituting surfaces depending on the distances to them from the hydraulic excavator, selects the nearest landform constituting surface, and displays the selected landform constituting surface in a different color. (Step S150)

Next, the panel computer determines whether a two-dimensional display mode is selected as an image display mode (step S155). If the two-dimensional display switch 48*f* of the setting unit 48 shown in FIG. 12 is depressed, the image is displayed in the two-dimensional display mode as shown in FIG. 8 (step S160). If not so, the panel computer proceeds to step S165.

Subsequently, the panel computer computes a three-dimensional intersect line between a plane in the direction of the bucket operation and the selected landform constituting surface (step S165), and displays the three-dimensional intersect line, the machine body S and the bucket B, looking from a side of the machine body, in the sub-screen area 46*b* of the display unit 46 as shown in FIG. 10 (step S170).

On the other hand, if no target landform constituting surfaces are found in step S145, the panel computer displays, on the display unit 46, a message "No surfaces constituting the three-dimensional target landform along which excavation is feasible by the hydraulic excavator in the current posture thereof", as shown in FIG. 9 (step S175).

Figure 15:
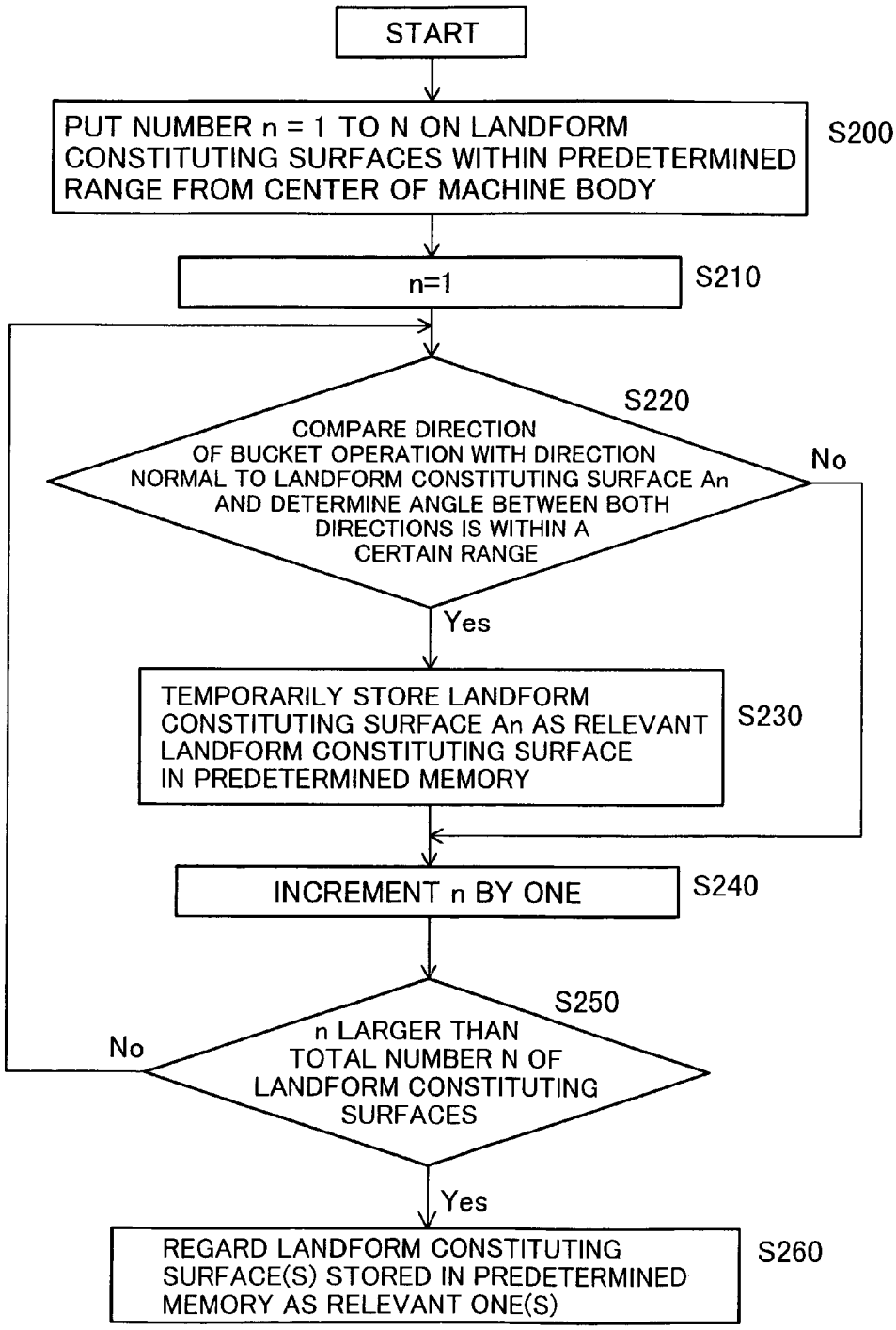
FIG. 15 is a flowchart showing the processing function of the panel computer serving as an excavation surface teaching device according to one embodiment of the present invention.

FIG. 15 is a flowchart showing details of the process of selecting the target landform constituting surface in step S140.

Referring to FIG. 15, first, the landform constituting surfaces within the range of a predetermined distance from the center of the machine body (e.g., bucket-reachable distance (10 m) over which excavation is feasible) are numbered from "1" to "N" using a variable n. Then, the variable n is set to "1" as an initial value (step S210). Subsequently, the panel computer compares the direction of the bucket operation with the direction normal to the n-th one An of the plural landform constituting surfaces, and determines whether an angle between both the directions is within a certain range (step S220). If the angle is within the certain range, that landform constituting surface is temporarily stored in a memory on judgment that it corresponds to the target landform constituting surface (step S230). Thereafter, the variable n is incremented by one (step S240). It is determined whether the variable n is larger than a total number N of the landform constituting surfaces (step S250). If the variable n is smaller than the total number N, the panel computer returns to step S210 and repeats the processing of steps S220 to S250. If the variable n is larger than the total number N, one ore more landform constituting surfaces stored in the memory are regarded as the relevant target landform constituting surfaces (step S260).

Figure 16:
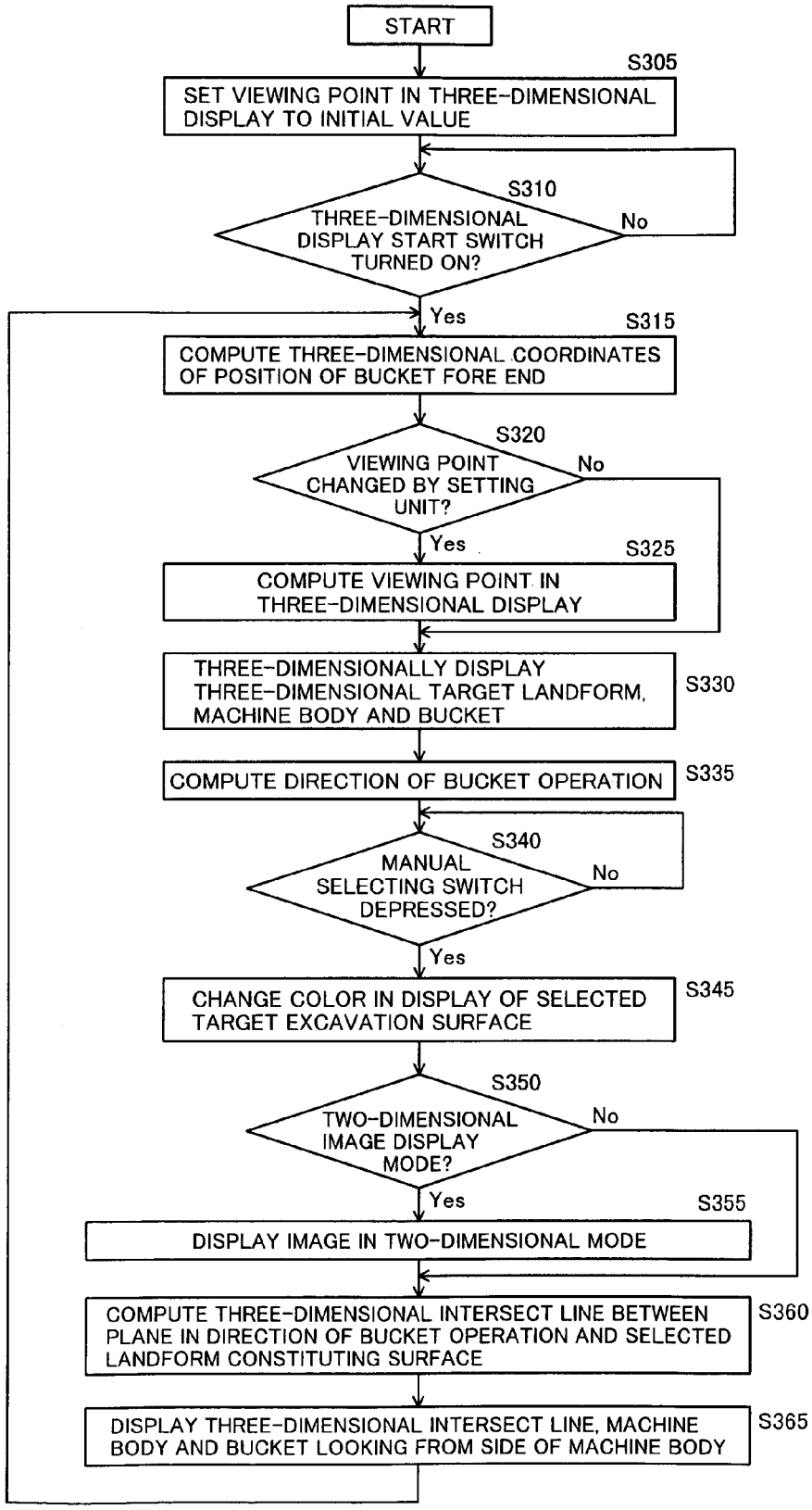
FIG. 16 is a flowchart showing the processing function of the panel computer serving as an excavation surface teaching device according to one embodiment of the present invention.

The details of the process of manually setting the target excavation surface will be described below with reference to FIG. 16. Processing procedures of steps S305 to S335 and S350 to S365 are the same as those of steps S105 to S135 and S155 to S170 in FIG. 14.

When the operator operates the front operating mechanism to move the bucket fore end to a position the excavation surface to be set as a target and depresses the manual selecting switch 48*d* of the setting unit 48 for direct teaching of the target excavation surface (step S340), the color of the selected excavation surface is changed to display it as the target excavation surface (step S345).

The above description is made as usually computing the three-dimensional intersect line between the plane defining the vertical cross-section extending in the same direction as the orientation of the bucket and the three-dimensional target landform, and displaying the computed intersect line on the display unit 46 together with the machine body and the bucket, as shown in FIG. 7. However, the operator may depress the switch 48*f* of the setting unit 48 so that the three-dimensional target landform, the machine body and the bucket are displayed on the same screen as viewed from above, as shown in FIG. 8. In other words, the operator is able to carry out the work while confirming the target excavation surface by changing over the display selection switch as appropriate.

After setting the target excavation surface, the operator can perform excavation along the target excavation surface while confirming the screen on which, as shown in FIG. 7, the three-dimensional intersect line between the plane defining the vertical cross-section extending in the same direction as the orientation of the bucket and the three-dimensional target excavation surface are displayed together with the machine body and the bucket. As a result, the intended excavation can be achieved at high accuracy even in the case of a complicated three-dimensional landform.

When the message "No surfaces constituting the three-dimensional target landform along which excavation is feasibly by the hydraulic excavator in the current posture thereof" is displayed on the display unit 46 in step S175 of FIG. 14, the operator swings the upper swing body 3 as appropriate, whereupon the panel computer 45 executes the processing shown in FIG. 14 again to select and display one or more small plane surfaces constituting the three-dimensional target landform and satisfying that the plane in which the bucket of the hydraulic excavator orienting in a new direction operates and the direction normal to each of those small plane surfaces are parallel to each other within the preset range of error. Unless the landform constituting surface satisfying the above condition is selected and displayed, the operator operates the lower travel structure to move in an appropriate direction and swings the upper swing body in a repeated way, whereby the target excavation surface can be eventually selected and displayed.

Note that this embodiment is not limited to the details described above, and may be modified in various ways. For example, while the bucket and the machine body are both displayed in the above-described embodiment, the whole or a part of the hydraulic excavator may be optionally displayed on condition at least an excavating portion at the fore end of the bucket is displayed. Also, when there are plural small plane surfaces constituting the three-dimensional target landform and satisfying that the plane in which the bucket of the hydraulic excavator in the current orientation operates and the direction normal to each of those small plane surfaces are parallel to each other within the preset range of error, the target excavation surface may be taught by employing a touch panel and directly designating one of triangular polygons displayed on the screen by a finger. Further, a setting mode switch may also be provided which switches over a mode of automatically selecting and setting one of small plane surfaces constituting the three-dimensional target landform and satisfying that the plane in which the bucket of the hydraulic excavator in the current orientation operates and the direction normal to each of those small plane surfaces are parallel to each other within the preset range of error, and a mode in which the operator selects and sets the target excavation surface by himself from the beginning. While angle meters for detecting rotational angles are used as means for detecting relative angles between the respective members of the front device, respective strokes of the corresponding cylinders may be detected instead. Additionally, while the detected three-dimensional position of the bucket fore end is transmitted to the computer 58 in the office, the three-dimensional position data may not be transmitted unless management of such data is required.

With this embodiment, as described above, even in complicated three-dimensional terrains where the landform positioned below the bucket and subjected to excavation changes with the movement of the hydraulic excavator or the movement of the bucket, when the target excavation surface is taught corresponding to the current position of the construction machine, the panel computer computes the three-dimensional intersect line between the plane defining the vertical cross-section extending in the same direction as the orientation of the operating mechanism and the target excavation surface, and displays the computed intersect line on the same screen of the display unit together with the machine body and the operating mechanism. Therefore, the operator can confirm the target excavation surface corresponding to the current position of the construction machine and can perform excavation to form the three-dimensional target landform by operating the operating mechanism along the target excavation surface while looking at the target excavation surface and the operating mechanism both displayed on the display. Also, a small plane surface satisfying that the direction line normal to the small plane surface and the direction line in which the operating mechanism of the construction machine orients are parallel to each other within the preset range of error is selected and set as the target excavation surface, and an image of the site looking from above is also displayed in the same screen. Hence, the operator can easily confirm along which one of the plane surfaces the excavation is feasible at that time. Even in work of forming the face of slope in complicated three-dimensional landforms, therefore, the target excavation surface can be easily confirmed and the working efficiency in practical excavation can be increased.

With reference to FIGS. 17 to 21, a description will be made below of the case in which an excavation teaching device for a construction machine according to another embodiment of the present invention is applied to a hydraulic excavator.

A work position measuring system employing the excavation teaching device for the construction machine according to this embodiment has the same configuration as that shown FIG. 1. Also, the hydraulic excavator equipped with the excavation teaching device for the construction machine according to this embodiment of the present invention has the same outward appearance as that shown in FIG. 2. Further, an office-side system serving as a GPS reference station has the same configuration as that shown FIG. 3. In addition, details of three-dimensional position processing executed in the panel computer 45 are the same as those shown FIGS. 4 to 6.

Figure 17:
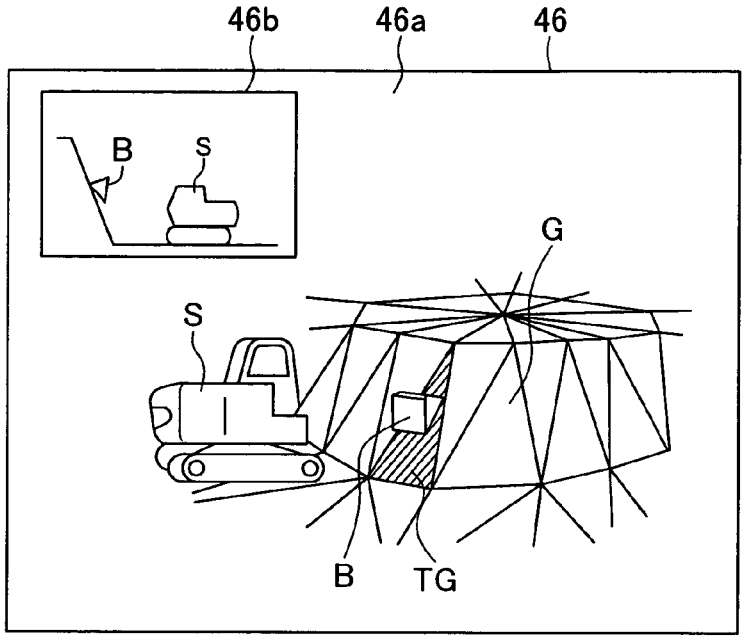
FIG. 17 shows a first display example displayed on the display screen of the display unit.
Figure 18:
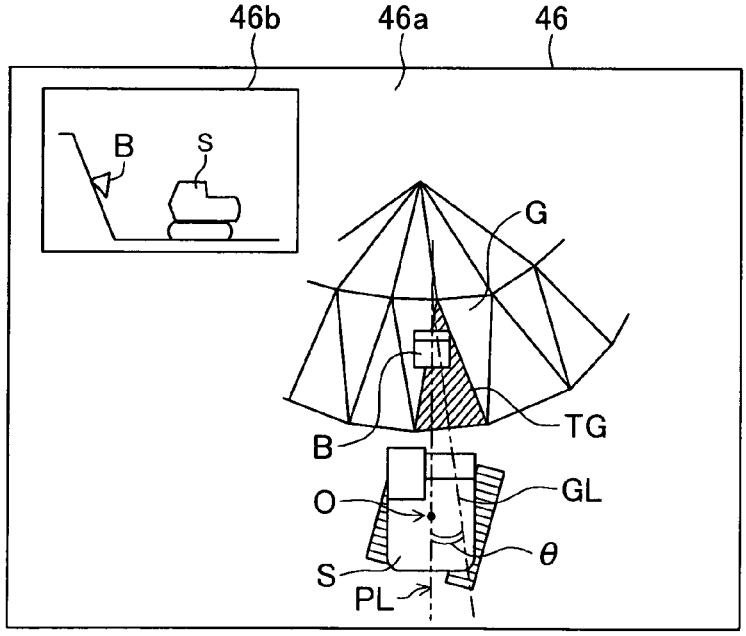
FIG. 18 shows a second display example displayed on the display screen of the display unit.

Display examples of images displayed on the display screen of the display unit 46 are shown in FIGS. 17 to 18.

FIG. 17 shows a first position display example displayed on the display screen of the display unit 46. The display unit 46 displays images in a first screen area 46*a* and a second screen area 46*b*. By using the three-dimensional positions determined through the three-dimensional position processing executed in the panel computer 45, the first screen area 46*a* displays illustrations of the body S and the bucket B of the hydraulic excavator, as shown in FIG. 17, at respective three-dimensional positions on the three-dimensional target landform G, which is stored in the predetermined memory in advance. Also, a target excavation surface TG (hatched in the drawing) taught by the excavation teaching device of this embodiment is displayed in a different color from that of other excavation surfaces. The image displayed on the display unit 46 can be changed to another one looking from any desired viewing point with the operation of the setting unit 48.

Further, the panel computer 45 computes a three-dimensional intersect line between a plane defining a vertical cross-section extending in the same direction as the orientation of the bucket (i.e., a plane in which the bucket operates or a plane fixed to the upper swing body in which the bucket operates with the operation of the front operating mechanism) and the three-dimensional target landform, and displays the computed intersect line as the image in the second screen area 46*b* together with the machine body S and the bucket B, thereby informing an operator of the working status.

With such simultaneous presentation of both the three-dimensional position display and cross-sectional display, the positional relationships of the machine body S and the bucket B relative to the target excavation surface TG can be displayed so that the operator recognize those positional relationships by intuition.

FIG. 18 shows a second position display example displayed on the display screen of the display unit 46. The first screen area 46*a* displays a two-dimensional image as viewed from above. When the operator sets, as a target, one of small plane surfaces constituting a three-dimensional landform by the setting unit 48, the panel computer 45 displays a direction PL in which the bucket of the hydraulic excavator operates with the current orientation thereof (i.e., a straight line resulting when viewing from right above the plane in which the bucket operates), a line GL resulting from projecting a line normal to the selected small plane surface on a horizontal plane, and the center O about which the body S of the hydraulic excavator swings.

Figure 19:
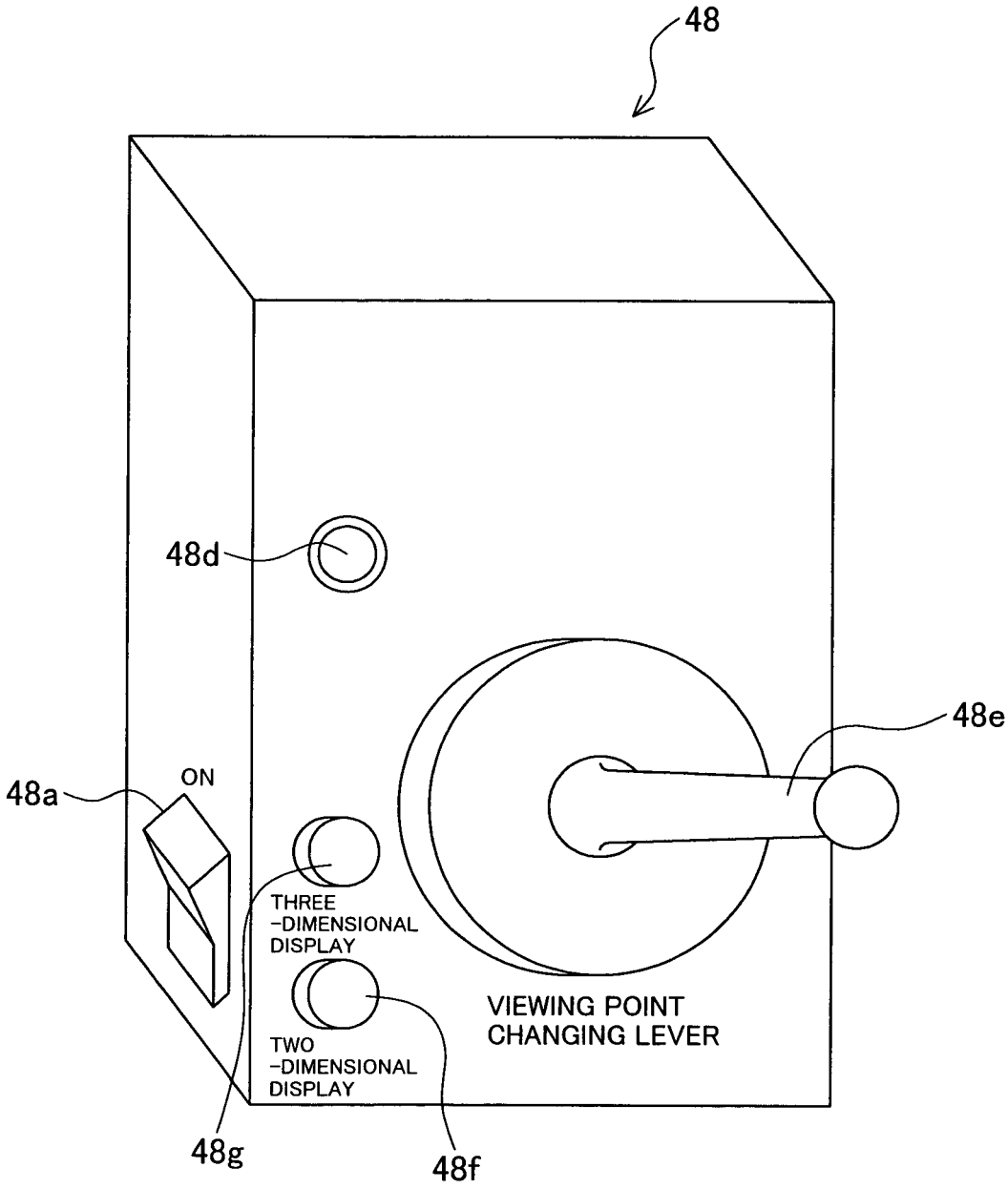
FIG. 19 is perspective view showing an outward appearance of a setting unit used in another embodiment.

FIG. 19 is perspective view showing an outward appearance of a setting unit 48 used in this embodiment. The setting unit 48 has a switch 48*a* for turning on/off the start of display on the display unit 46; a manual setting switch 48*d* for manually setting the target excavation surface; a joystick 48*e* for moving the viewing point in three-dimensional display; a two-dimensional display switch 48*f* for switching over the screen image on the display unit to the two-dimensional display viewing the site from above as shown in FIG. 18; and a three-dimensional display switch 48*g* for switching over the screen image on the display unit to the three-dimensional display as shown in FIG. 17.

The processing functions of the panel computer 45 constituting the excavation surface teaching device of this embodiment will be described below with reference to a flowchart shown in FIG. 20.

When displaying the illustrations of the body and the bucket of the hydraulic excavator, as shown in FIG. 18, at respective three-dimensional positions on the three-dimensional target landform stored in the predetermined memory in advance, the panel computer 45 displays, as guides for the excavation, a line representing the direction in which the bucket of the hydraulic excavator operates, the center position of the machine body, and a line resulting from projecting a line perpendicular to the target excavation surface on a horizontal plane on the same screen.

When operating the bucket to carry out excavation along the target excavation surface, unless the direction line in which the bucket operates and the line resulting from projecting the line perpendicular to the target excavation surface on a horizontal plane are substantially parallel to each other, an edge of the bucket may dig into the target excavation surface or may float from the target excavation surface because the bucket has a certain transverse width. To avoid such a problem, by looking at the line representing the direction in which the bucket operates, the center position of the machine body, and the line resulting from projecting the line perpendicular to the target excavation surface on a horizontal plane, which are displayed on the screen of the display unit, the operator can operate the hydraulic excavator to swing the machine body and/or move the lower travel structure while judging in which direction and how distance the bucket is to be operated to perform the excavation in optimum condition, thus making the line representing the direction in which the bucket operates and the line perpendicular to the target excavation surface substantially parallel to each other. After the line representing the direction in which the bucket operates and the line perpendicular to the target excavation surface have become substantially parallel to each other, the operator performs the excavation along the target excavation surface while confirming the three-dimensional intersect line between the plane defining the vertical cross-section extending in the same direction as the orientation of the bucket and the three-dimensional target excavation surface, the machine body, and the bucket which are displayed on the sub-screen area 46*b* shown in FIG. 17 or FIG. 18. As a result, the intended excavation can be achieved at high accuracy even in the case of complicated three-dimensional landforms.

When the line representing the direction in which the bucket operates and the line resulting from projecting the line perpendicular to the target excavation surface on a horizontal plane are not parallel to each other, both the lines can be made substantially parallel to each other by using the following methods. According to the first method, while looking at the image on the display unit 46 shown in FIG. 18, the operator moves the lower travel structure so that the center O of the machine body S comes closer to the line GL resulting from projecting the line perpendicular to the target excavation surface, and then swings the upper swing body so that the line PL representing the direction in which the bucket operates and the line GL resulting from projecting the line perpendicular to the target excavation surface on a horizontal plane are substantially aligned with each other. According to the second method, the operator swings the upper swing body so that the line PL representing the direction in which the bucket operates and the line GL resulting from projecting the line perpendicular to the target excavation surface on a horizontal plane are parallel each other.

When operating the bucket to carry out excavation along the target excavation surface, unless the plane in which the bucket operates and the line perpendicular to the target excavation surface are substantially parallel to each other, the bucket edge may dig into the target excavation surface or may float from the target excavation surface because the bucket has a certain transverse width. To avoid such a problem, with this embodiment, since the line representing the direction in which the bucket of the hydraulic excavator operates, the center position of the machine body, and the line resulting from projecting the line perpendicular to the target excavation surface on a horizontal plane are displayed on the screen, the operator can intuitively confirm the direction in which the upper swing body is to be swung and the direction in which the lower travel structure is to be moved. It is therefore possible to easily move the machine body and to increase the working efficiency.

Figure 20:
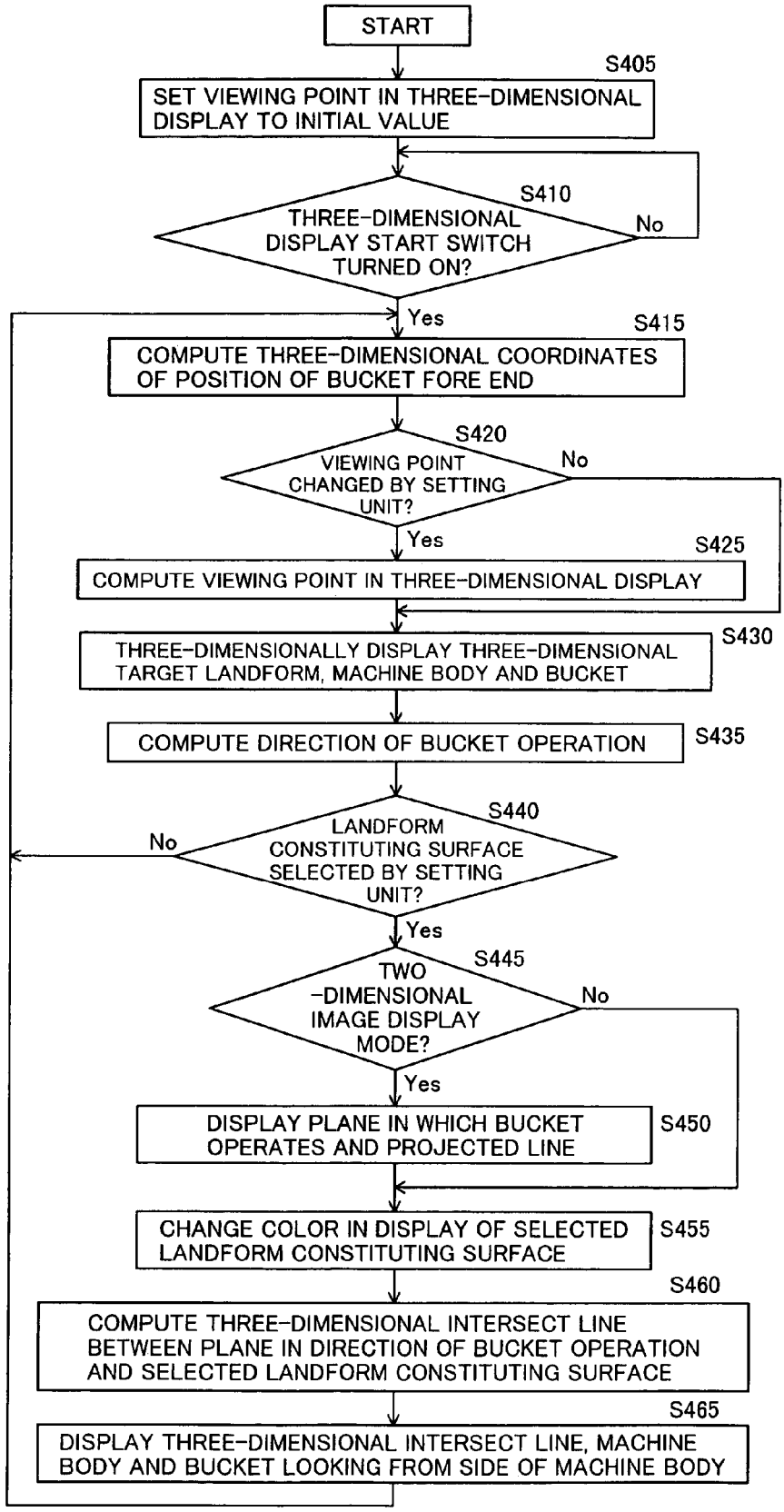
FIG. 20 is a flowchart showing the processing function of a panel computer serving as an excavation surface teaching device according to another embodiment.

Referring to FIG. 20, the panel computer 45 sets the viewing point in three-dimensional display to an initial value (step S405). Then, the panel computer 45 determines whether the three-dimensional display start switch 48*a* of the setting unit 48 is turned on (step S410), and proceeds to step S415 if the switch 48*a* is turned on. The panel computer 45 obtains the position data of the antennas 31, 32 from the GPS receivers 43, 44 and computes three-dimensional coordinates of the fore end position of the bucket 7 in the same manner as that described above with reference to FIGS. 4 to 6 (step S415). Details of steps S405, S415 are as per described in connection with steps S10 to S70 of FIG. 6.

Then, the panel computer determines whether the viewing point has been changed with the operation of the joystick 48*e* of the setting unit 48 (step S420). If changed, it computes the viewing point in three-dimensional display with respect to the position to which the viewing point has been changed (step S425). Subsequently, three-dimensional display of the three-dimensional target landform G, the machine body S and the bucket B is presented on the display screen of the display unit 48 as shown in FIG. 17 (step S430). Thereafter, the panel computer computes the direction of the bucket operation (step S435).

Subsequently, the panel computer determines whether a landform constituting surface is selected by the setting unit (S440), and if selected, it proceeds to step S445. In other words, when the operator sets, as a target, one of small plane surfaces constituting a three-dimensional landform by using the target surface setting switch 48*d* of the setting unit 48 shown in FIG. 19, the panel computer proceeds to step S445.

If the landform constituting surface is selected, the panel computer determines whether a two-dimensional display mode is selected as an image display mode (step S445). If the two-dimensional display switch 48*f* of the setting unit 48 shown in FIG. 19 is depressed, the panel computer proceeds to step S450, and if not so, it proceeds to step S465.

If the two-dimensional display switch 48f is depressed, a two-dimensional image as viewed from above is displayed in the first screen area 46*a* of the display unit 46 as shown in FIG. 18. Stated another way, when the operator sets, as a target, one of small plane surfaces constituting a three-dimensional landform by using the setting unit 48, the panel computer 25 displays the direction PL in which the bucket of the hydraulic excavator operates with the current orientation thereof (i.e., a straight line resulting when viewing from right above the plane in which the bucket operates), and the line GL resulting from projecting the line normal to one of the small plane surfaces constituting the three-dimensional target landform on a horizontal plane. The center O about which the body S of the hydraulic excavator swings is also displayed.

Next, the panel computer changes the display color of the landform constituting surface selected in step S440 (step S445). More specifically, in the three-dimensional display mode, the target excavation surface TG is displayed in a different color from that of the other landform constituting surfaces as shown in FIG. 17. Also, in the case of two-dimensional display as viewed from right above, the target excavation surface TG is displayed in a different color from that of the other landform constituting surfaces as shown in FIG. 18.

Then, the panel computer computes a three-dimensional intersect line between a plane in the direction of the bucket operation and the selected landform constituting surface (step S460), and displays the three-dimensional intersect line, the machine body S and the bucket B, looking from a side of the machine body, in the sub-screen area 46*b* of the display unit 46 as shown in FIG. 17 (step S465).

After setting the target excavation surface, the operator can perform excavation along the target excavation surface while confirming the screen on which, as shown in FIG. 17, the three-dimensional intersect line between the plane defining the vertical cross-section extending in the same direction as the orientation of the bucket and the three-dimensional target excavation surface are displayed together with the machine body and the bucket. As a result, the intended excavation can be achieved at high accuracy even in the case of complicated three-dimensional landforms.

Figure 21:
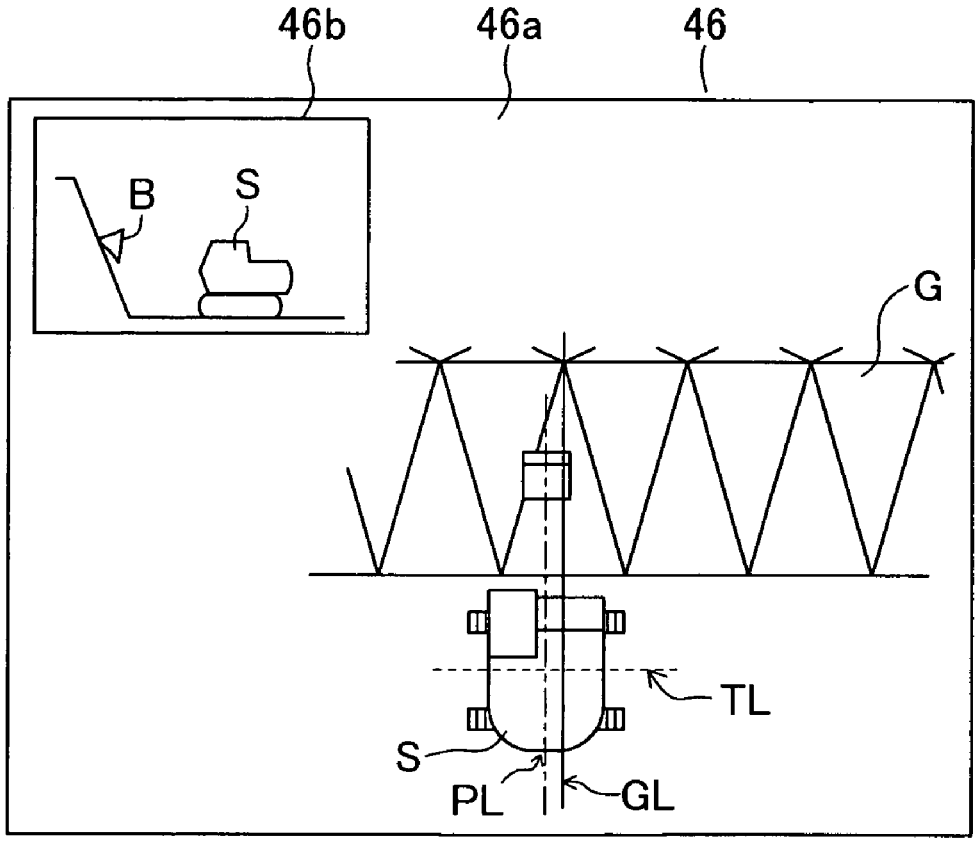
FIG. 21 shows a third display example displayed on the display screen of the display unit.

Further, in work of forming the face G of slope that is laterally extended long substantially in the same direction as shown in FIG. 21, the slope face forming is performed while moving the travel body S orientated in the direction in which the face of slope is extended. In such a case, by displaying on the same screen a line TL representing the direction in which the travel body S is moved, the operator can confirm whether the direction in which the face G of slope is extended is substantially parallel to the line TL representing the direction in which the travel body S is moved. It is hence possible to cut troublesome operation to correct the position of hydraulic excavator whenever the direction of movement of the travel body deviates slightly, and to increase the working efficiency.

Note that this embodiment is not limited to the details described above, and may be modified in various ways. For example, while the bucket and the machine body are both displayed in the above-described embodiment, the whole or a part of the hydraulic excavator may be optionally displayed if at least an excavating portion at the fore end of the bucket is displayed. Also, the line representing the direction perpendicular to the target excavation surface, the line representing the direction in which the operating mechanism of the construction machine, such as a hydraulic excavator, operates, the center position of the machine body, and the line representing the orientation of the travel body, which are displayed on the display units 46 and 59, may be displayed in different colors from one another. Further, lines representing the directions perpendicular to plural triangular polygons in the vicinity of the target excavation surface may be displayed at the same time. Moreover, the target excavation surface may be displayed in a different color from that of the other triangular polygons or in a blinking way. As another teaching method, the target excavation surface may be taught, for example, by employing a touch panel and directly designating one of the triangular polygons displayed on the screen by a finger. While angle meters for detecting rotational angles are used as means for detecting relative angles between the respective members of the front device, respective strokes of the corresponding cylinders may be detected instead. While the detected three-dimensional position of the bucket fore end is transmitted to the computer 58 in the office, the three-dimensional position data may not be transmitted unless management of such data is required. Additionally, while this employs a plane right coordinate system, a UTM coordinate system may be instead employed. In the UTM (Universal Transverse Mercator's projection) coordinate system, the earth is projected for each of 60 identical zones obtained by dividing the earth at intervals of 6 degrees of the longitude. Then, the central longitude of each zone is defined as the central meridian, and a cross point between the central meridian and the equator is defined as the origin of the zone.

With this embodiment, as described above, even in complicated three-dimensional terrains where the landform positioned below the bucket and subjected to excavation changes with the movement of the hydraulic excavator or the movement of the bucket, when the target excavation surface is taught corresponding to the current position of the construction machine, the panel computer computes the three-dimensional intersect line between the plane defining the vertical cross-section extending in the same direction as the orientation of the operating mechanism and the target excavation surface, and display the computed intersect line on the same screen of the display unit together with the machine body and the operating mechanism. Therefore, the operator can confirm the target excavation surface corresponding to the current position of the construction machine and carry out excavation to form the three-dimensional target landform by operating the operating mechanism along the target excavation surface while looking at the target excavation surface and the operating mechanism both displayed on the display. Also, since the line representing the direction perpendicular to the target excavation surface, the line representing the direction in which the operating mechanism of the construction machine orients, and the image viewing the center position of the construction machine from above are displayed on the same screen, the operator can intuitively easily confirm the position optimum for the construction machine to perform the excavation along the target excavation surface. Further, because of including display means for displaying, on the same screen, the direction line indicating the orientation of the travel body, the operator can intuitively easily confirm in which direction the machine body is moved by the traveling operation. Hence, the traveling operation can be performed without loss and the working efficiency can be increased.

INDUSTRIAL APPLICABILITY

According to the present invention, even in work of forming the face of slope in complicated three-dimensional landforms, it is possible to easily confirm a proper target excavation surface and to increase the working efficiency during excavation.

Also, according to the present invention, even in work of forming the face of slope in complicated three-dimensional landforms, it is possible to easily confirm a proper target excavation surface, to facilitate positioning of the machine body during excavation, and to increase the working efficiency.

The invention claimed is:

1. An excavation teaching device for a construction machine for carrying out excavation to shape a three-dimensional landform into a three-dimensional target landform having a specific grade with operation of an operating mechanism for excavation, said excavation teaching device comprising position measuring means for measuring a three-dimensional position of an operating mechanism of said construction machine, and display means for displaying a positional relationship between the three-dimensional target landform and said operating mechanism in accordance with a measured result of said position measuring means, wherein said display means displays, as an image in a first screen area, a plurality of small plane surfaces constituting the three-dimensional target landform and an illustration of the whole or a part of said construction machine including a body of said construction machine and at least a fore end portion of said operating mechanism, and said excavation teaching device automatically selects and said display means discriminatively displays in said first screen area, as a target excavation surface, one of the plurality of small plane surfaces constituting the three-dimensional target landform, which satisfies that the direction normal to the one small plane surface is parallel within a range of allowable error, to a vertical plane in which said operating mechanism operates whereby the target landform is excavated to the specific grade.

2. An excavation teaching device for a construction machine according to claim 1, wherein said display means displays, as an image in a second screen area representing a cross-sectional view taken along a plane in which said operating mechanism operates, an intersect line between the plane in which said operating mechanism operates and the plurality of small plane surfaces, and the illustration of the whole or a part of said construction machine concurrently with the image in said first screen area.

3. An excavation teaching device for a construction machine according to claim 1, wherein when there are a plurality of target excavation surfaces, said display means discriminately displays one of the target excavation surfaces which is nearest to said operating mechanism.

4. An excavation teaching device for a construction machine according to claim 1, wherein when there are a plurality of target excavation surfaces, said display means displays the target excavation surfaces in different color tones such that the order in distance from the direction normal to each target excavation surface to the plane in which said operating mechanism operates is represented from the nearest to farthest target excavation surface.

5. An excavation teaching device for a construction machine according to claim 1, further comprising switching means for switching-over from an automatic setting mode to a manual setting mode in selection of the target excavation surface, wherein when the manual setting mode is selected by said switching means, said display means discriminatively displays the small plane surface selected by an operator.

6. An excavation teaching device for a construction machine according to claim 1, wherein said display means discriminatively displays one or more of the plurality of small plane surfaces constituting the three-dimensional target landform which are positioned within a predetermined distance from said construction machine.

7. An excavation teaching device for a construction machine according to claim 1, wherein when none of the plurality of small plane surfaces constituting the three-dimensional target landform satisfies that the direction normal to each small plane surface is parallel within the range of allowable error to the plane in which said operating mechanism operates, said display means displays a message indicating the absence of the relevant small plane surfaces.

8. An excavation teaching device for a construction machine according to claim 1, wherein said display means further displays, in said first screen area, a line resulting from projecting a line normal to the target excavation surface, selected from among the plurality of small plane surfaces constituting the three-dimensional target landform, on a horizontal plane and the direction in which the operating mechanism of said construction machine operates with current orientation thereof.

9. An excavation teaching device for a construction machine according to claim 8, wherein said display means concurrently displays, in said first screen area, a center position of the body of said construction machine.

10. An excavation teaching device for a construction machine according to claim 8, wherein said display means displays, as an image in a second screen area representing a cross-sectional view taken along a plane in which said operating mechanism operates, an intersect line between the plane in which said operating mechanism operates and the plurality of small plane surfaces, and the illustration of the whole or a part of said construction machine concurrently with the image in said first screen area.

11. An excavation teaching device for a construction machine according to claim 8, wherein said display means concurrently displays, in said first screen area, a line representing the direction in which a travel body of said construction machine is moved.

12. An excavation teaching device for a construction machine for carrying out excavation to shape a three-dimensional landform into a three-dimensional target landform having a specific grade with operation of an operating mechanism for excavation, said excavation teaching device comprising position measuring means for measuring a three-dimensional position of an operating mechanism of said construction machine, and display means for displaying a positional relationship between the three- dimensional target landform and said operating mechanism in accordance with a measured result of said position measuring means, wherein said display means displays, as an image in a first screen area, a plurality of small plane surfaces constituting the three-dimensional target landform and an illustration of the whole or a part of said construction machine including at least a fore end portion of said operating mechanism, and further displays, in said first screen area, a line resulting from projecting a line normal to a target excavation surface, selected from among the plurality of small plane surfaces constituting the three-dimensional target landform, on a horizontal plane and the direction in a vertical plane in which the operating mechanism of said construction machine operates with current orientation thereof, whereby the target landform is excavated to the specific grade.

13. An excavation teaching device for a construction machine according to claim 12, wherein said display means concurrently displays, in said first screen area, a center position of a body of said construction machine.

14. An excavation teaching device for a construction machine according to claim 12, wherein said display means displays, as an image in a second screen area representing a cross-sectional view taken along a plane in which said operating mechanism operates, an intersect line between the plane in which said operating mechanism operates and the plurality of small plane surfaces, and the illustration of the whole or a part of said construction machine concurrently with the image in said first screen area.

15. An excavation teaching device for a construction machine according to claim 12, wherein said display means concurrently displays, in said first screen area, a line representing the direction in which a travel body of said construction machine is moved.

* * * * *